US009304446B2

(12) United States Patent
Akita et al.

(10) Patent No.: US 9,304,446 B2
(45) Date of Patent: Apr. 5, 2016

(54) DEVELOPING DEVICE HAVING DEVELOPER LAYER REGULATION

(71) Applicant: CANON KABUSHIKI KAISHA, Tokyo (JP)

(72) Inventors: Masanori Akita, Toride (JP); Atsushi Matsumoto, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/376,952

(22) PCT Filed: Apr. 26, 2013

(86) PCT No.: PCT/JP2013/062878

§ 371 (c)(1),
(2) Date: Aug. 6, 2014

(87) PCT Pub. No.: WO2013/162074

PCT Pub. Date: Oct. 31, 2013

(65) Prior Publication Data

US 2015/0010335 A1 Jan. 8, 2015

(30) Foreign Application Priority Data

Apr. 27, 2012 (JP) ..... 2012-103803

(51) Int. Cl.
*G03G 15/08* (2006.01)
*G03G 15/09* (2006.01)

(52) U.S. Cl.
CPC ..... *G03G 15/0921* (2013.01); *G03G 15/0812* (2013.01)

(58) Field of Classification Search
CPC ..... G03G 15/09; G03G 15/0921; G03G 15/0812; G03G 2215/0609
USPC ..... 399/267, 274, 275, 277
See application file for complete search history.

(56) References Cited

U.S. PATENT DOCUMENTS 4,676,192 A * 6/1987 Yuge et al. ..... 399/259
5,805,965 A * 9/1998 Tsuda et al. ..... 399/281

(Continued)

FOREIGN PATENT DOCUMENTS

JP 05-035067 A 2/1993
JP 2006-301065 A 11/2006

(Continued)

OTHER PUBLICATIONS

European Search Report received Nov. 27, 2015, in related European Patent Application No. 13780906.7.

*Primary Examiner* — Robert Beatty
(74) *Attorney, Agent, or Firm* — Fitzpatrick, Cella, Harper & Scinto

(57) ABSTRACT

A developing device includes a developer carrying member for carrying a developer comprising a toner and a carrier, a magnet provided inside the developer carrying member, a developing chamber for feeding the developer to the developer carrying member, and a feeding member rotatably provided in the developing chamber for feeding the developer in the developing chamber. A non-magnetic blade member regulates an amount of the developer to be coated on said developer carrying member, and a route forming portion forms a route for feeding a developer in the developing chamber. The magnet is opposed to a region inside of the developer carrying member from a downstream end of an opposing portion to the blade member with the rotational direction of said developer carrying member so as to attract the developer on the region.

13 Claims, 25 Drawing Sheets

(56) References Cited

U.S. PATENT DOCUMENTS

| | | | | |
|---|---|---|---|---|
| 7,050,745 | B2 * | 5/2006 | Kikuchi | 399/272 |
| 7,792,472 | B2 * | 9/2010 | Ichikawa et al. | 399/267 |
| 7,907,855 | B2 | 3/2011 | Akita | |
| 8,073,368 | B2 | 12/2011 | Iwata et al. | |
| 8,571,449 | B2 * | 10/2013 | Miyoshi et al. | 399/277 |
| 8,750,752 | B2 | 6/2014 | Miyoshi et al. | |
| 2007/0166079 | A1 | 7/2007 | Ichikawa et al. | |
| 2012/0051793 | A1 * | 3/2012 | Kudo et al. | 399/254 |
| 2012/0051797 | A1 * | 3/2012 | Suzuki et al. | 399/272 |
| 2013/0287449 | A1 | 10/2013 | Matsumoto | |

FOREIGN PATENT DOCUMENTS

| | | | |
|---|---|---|---|
| JP | 2007-310340 | A | 11/2007 |
| JP | 2009-115845 | A | 5/2009 |
| JP | 2009-151029 | A | 7/2009 |
| JP | 2010-092001 | A | 4/2010 |
| JP | 2010-204639 | A | 9/2010 |

* cited by examiner

DEVELOPING DEVICE HAVING DEVELOPER LAYER REGULATION

TECHNICAL FIELD

The present invention relates to a developing device usable with an image forming apparatus for forming an image by using an electrophotographic process, and particularly relates to the developing device usable with the image forming apparatus such as a copying machine, a printer, a facsimile machine or a multi-function machine having a plurality of functions of these machines.

BACKGROUND ART

In a conventional image forming apparatus of the electrophotographic type, in general, a surface of a drum-like photosensitive member as an image bearing member is electrically charged uniformly by a charger and then the charged photosensitive member is exposed to light depending on image information by an exposure device to form an electrostatic latent image on the photosensitive member. The electrostatic latent image formed on the photosensitive member is visualized as a toner image by a toner contained in a developer by using the developing device.

As such a developing device, there is a developing device using, as the developer, a two-component developer including non-magnetic toner particles (toner) and magnetic carrier particles (carrier). Particularly, in a color image forming apparatus, the toner may contain no magnetic material and therefore the two-component developer has been widely used for the reason such that color (tilt) is good or the like.

In such a developing device, in general, a regulating blade as a layer thickness regulating member is provided so as to be opposed to an outer peripheral surface of a developing sleeve through a predetermined gap in many cases. The developer carried on the developing sleeve is subjected to regulation of an amount thereof to be fed to a developing region in a process in which the developer passes through a gap between a developing sleeve 8 and a regulating blade 9 when the developer is fed to the developing region, so that the developer is adjusted so as to be fed (supplied) in a stable amount.

However, in the developing device in which the layer thickness regulation of the developer carried on the developing sleeve surface is effected by the regulating blade, the following problem can arise. FIG. 5 is a schematic sectional view showing a state of the two-component developer at a position upstream of the position of the regulating blade in the case where the conventionally known two-component developer is used. By a magnet incorporated in the developing sleeve, the developer is carried and fed to develop the electrostatic (latent) image. In such a developing device, the developer portion is divided into a portion where a flow of the developer is stopped by the regulating blade and a portion where the developer follows rotation of the developing sleeve to be fed at substantially the same speed as a rotational speed of the developing sleeve, so that a shear surface (plane) is generated at a boundary portion. A developer A located on the shear surface is pressed against the regulating blade by a circumferential force with the rotation of the developing sleeve, so that the developer is in a packed state and then is continuously stagnated in some cases. In the case where the developer on the shear surface is stagnated for a long term, at the boundary surface, a mobile developer layer and an immobile developer layer rub with each other. As a result, the toner is liberated from the carrier by the rubbing in the case of the two-component developer and then the liberated toner particles are liable to be adhered to each other by frictional heat due to the rubbing, thus forming the toner layer. The thus formed toner layer grows by continuous rotation of the developing sleeve 8, so that the gap between the regulating blade 9 and the developing sleeve 8 is obstructed, and thus the amount of the developer passing through the gap is lowered (hereinafter this phenomenon is referred to as improper coating). As a result, the amount of the developer conveyed to the developing region fluctuates, so that problems such as a density lowering and longitudinal density non-uniformity were generated.

In Japanese Laid-Open Patent Application (JP-A) Hei 5-035067, in order to prevent the formation of the immobile layer of the developer, provision of a cylindrical toner feeding member which steadily rotates always with a certain gap with the developing sleeve in an immediately upstream side of the regulating blade is proposed.

However, in JP-A Hei 5-035067, the formation of the immobile layer of the developer can be prevented but a bearing for supporting the toner feeding member and a driving means for driving the toner feeding member are required, so that it is inevitable that a constitution is complicated and a cost therefor is increased. In addition, the toner feeding member is driven in an opposite direction at a position where it opposes the developing sleeve and therefore strong stress is imposed on the developer, so that there is a possibility that the developer is deteriorated early.

SUMMARY OF INVENTION

The present invention has been accomplished in view of the above-described problems. A principal object of the present invention is to provide a developing device capable of suppressing, without providing an additional (new) member or the like, generation of image defect due to formation of an immobile layer in an upstream side of a developer regulating member for regulating an amount of a developer on a developer carrying member.

According to an aspect of the present invention, there is provided a developing device comprising: a developer carrying member for carrying a developer comprising a toner and a carrier; a magnet, provided inside the developer carrying member, including a plurality of magnetic poles with respect to a rotational direction of the developer carrying member; a developing chamber for feeding the developer to the developer carrying member; a non-magnetic blade member for regulating an amount of the developer to be coated on the developer carrying member; and a guiding portion for guiding the developer from above to the developer carrying member with respect to a direction of gravitation, wherein the guiding portion is provided, opposed to the blade member and the developer carrying member, upstream of the blade member with respect to the rotational direction of the developer carrying member, wherein a distance from a developer feeding start position of the guiding portion where feeding of the developer toward the developer carrying member starts to the blade member is 2 mm or more with respect to the rotational direction of the developer carrying member, and when a magnetic force at a surface of the developer carrying member with respect to a direction normal to the developer carrying member is Fr, the magnetic poles are provided so that a ratio of an integrated value FrNear obtained by integrating the magnetic force Fr from the blade member to a position of 2 mm upstream of the blade member with respect to the rotational direction of the developer carrying member to an integrated value FrAll obtained by integrating the magnetic force from the blade member to the developer feeding start position with respect to the rotational direction of the developer carrying member is 60% or more.

These and other objects, features and advantages of the present invention will become more apparent upon a consideration of the following description of the preferred embodiments of the present invention taken in conjunction with the accompanying drawings.

DESCRIPTION OF EMBODIMENTS

With reference to the drawings, embodiments of the present invention will be described specifically. However, with respect to dimensions, materials, shapes, relative arrangements, numerical values, and the like of constituent elements described in the following embodiments, the scope of the present invention is not limited thereto unless otherwise specified.

Embodiment 1

Image Forming Apparatus

Figure 1:
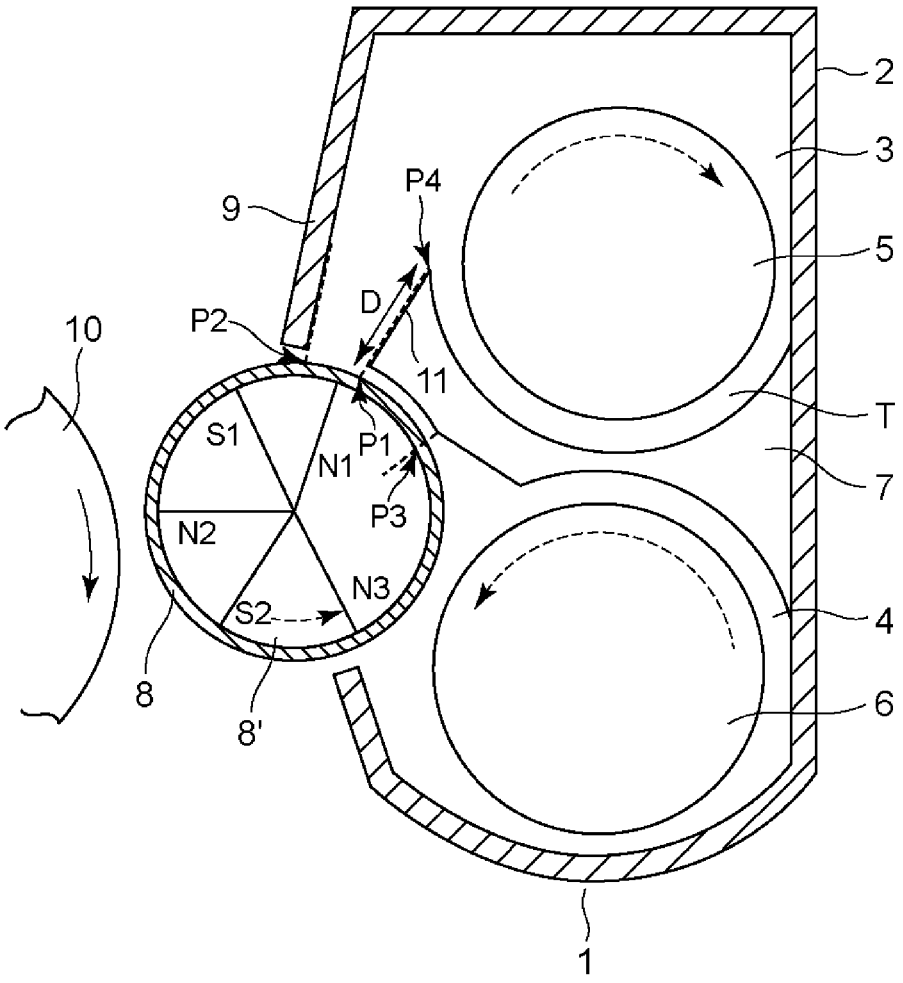
FIG. 1 is a schematic view for illustrating a developing device according to Embodiment 1 of the present invention.
Figure 2:
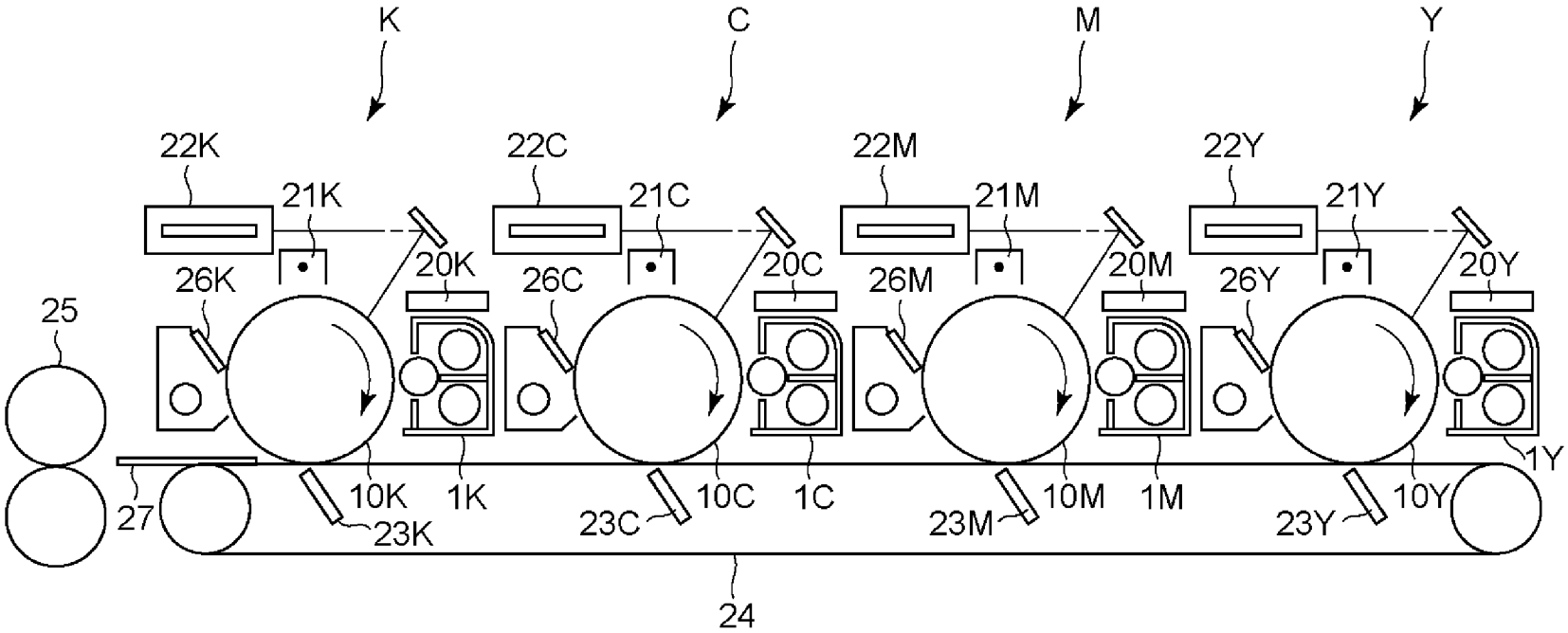
FIG. 2 is a schematic view for illustrating positional relationship of an image forming apparatus and the developing device in Embodiment 1.

FIG. 1 shows a positional relationship between an image bearing member (photosensitive drum) 10 and a developing device 1 at each of stations Y, M, C and K in a full-color image forming apparatus as shown in FIG. 2. The respective stations Y, M, C and K have substantially the same constitution and form images of yellow (Y), magenta (M), cyan (C) and black (K), respectively, for a full-color image. In the following description, e.g., the developing device 1 is used in common to developing devices 1Y, 1M, 1C and 1K at the stations Y, K, C and K.

First, when reference to FIG. 2, an operation of a whole image forming apparatus will be described. The photosensitive drum 10 as the image bearing member is rotationally provided, and is electrically charged uniformly by a primary charger 21 and then is exposed with light modulated depending on an information signal by a light emitting element 22 such as a laser, so that a latent image is formed. The latent image is visualized as a developer image (toner image) by the developing device 1 in a process described later. The toner image is transferred, every station by a first transfer charger 23, onto a transfer paper 27 as a recording material conveyed by a transfer material conveying sheet (belt) 24, and thereafter is fixed by a fixing device 25 to obtain a permanent image. Further, a transfer residual toner remaining on the photosensitive drum 10 is removed by a cleaning device 26. Further, the toner in an amount corresponding to that of the toner contained in the developer consumed by image formation is supplied from a toner supplying container 20. Further, in this embodiment, a method in which the toner images are directly transferred from the photosensitive drums 10Y, 10M, 10C and 10K onto the transfer paper 27 as the recording material conveyed by the transfer material conveying sheet 24 is employed but the present invention is not limited thereto. The present invention is also applicable to an image forming apparatus having a constitution in which an intermediary transfer member is provided in place of the transfer material conveying sheet 24, and the respective color toner images are, after being primary-transferred from the respective photosensitive drums 10Y, 10M, 10C and 10K, collectively secondary-transferred onto the transfer paper.

[Two-Component Developer]

Next, the two-component developer used in this embodiment is described. The toner contains colored particles made up of a binder resin, a coloring agent, colored resin particles containing other additives as desired, and external additives such as fine powder of colloidal silica. Further, the toner is formed of a negatively chargeable polyester resin material and is 7.0 μm in volume-average particle size in this embodiment.

As the material for the carrier, surface-oxidized or non-oxidized particles of a metallic substance, such as iron, nickel, cobalt, manganese, chrome, rare-earth metal and their alloys, or oxidized ferrite, and the like, can be suitably used. The method for manufacturing these magnetic particles is not particularly limited. In this embodiment, the carrier which was 40 μm in volume average particle size, $5\times10^8$ Ω·cm in volume resistivity, and 180 emu/cc in magnetization was used. The magnetization of the carrier may preferably be 100-300 emu/cc. When the magnitude of the magnetization is less than 100 emu/cc, a magnetic confining force between the developing sleeve and the carrier becomes small and therefore there is a possibility of carrier deposition on the photosensitive drum. On the other hand, when the magnitude of the magnetization is more than 300 emu/cc, rigidity of a magnetic chain of the two-component developer is increased, so that a so-called "chain non-uniformity" due to rubbing of the image with the magnetic chain is liable to occur. That is, for image formation using the two-component developing device, it is desirable that the magnitude (strength) of the magnetization of the carrier is 100-300 emu/cc.

In this embodiment, the two-component developer prepared by mixing the toner and the carrier in a weight-basis mixing ratio (weight ratio of toner weight to the sum of the toner weight and the carrier weight) of 8% is used. In this embodiment, a degree of agglomeration of the two-component developer was 40 degrees as measured at an angle of repose.

In the present invention, a proper range of the angle of repose of the developer is 20-60 degrees, preferably 30-50 degrees. When the angle of repose of the two-component developer is smaller than 20 degrees, due to high flowability, it is impossible to sufficiently satisfy problem solving of scattering and hollow dropout during a plurality of transfer operations and maintenance of a transfer property during continuous image formation. Further, when the angle of repose is larger than 60 degrees, a suppression level of the scattering and hollow dropout at an initial printing state are good but when the image formation is continued at high speed, deterioration of a developing property and screw locking by load are caused. In this embodiment, the developer of 40 degrees in angle of repose is used.

<Measuring Method>

Incidentally, with respect to the toner used in this embodiment, the weight-average particle size was measured with the use of the following apparatus and method. As the measuring apparatus of the weight-average particle size of the toner, a Coulter Counter TA-II or Coulter Multisizer (mfd. by Coulter Inc.) was used. As an electrolytic (aqueous) solution, 1% NaCl aqueous solution prepared by using a first class grade sodium chloride, such as ISOTONR-II (mfd. by Coulter Scientific Japan Ltd.), was used.

As the measuring method, 0.1-5 ml of a surfactant, preferably alkyl-benzene sulfonate, was added, as dispersant, into 100-150 ml of above-mentioned electrolytic aqueous solution. Then, 2-20 mg of a measurement sample was added to the above mixture. Then, the electrolytic aqueous solution in which the sample was suspended was subjected to dispersion by an ultrasonic dispersing device for about 1-3 minutes. Then, the volume and the number of the toner particles of 2 μm or more were measured with the use of the measuring apparatus fitted with an aperture, thus calculating a volume distribution and a number distribution.

The resistivity of the magnetic carrier used in this embodiment was measured in the following manner. That is, a cell of the sandwich type, which was 4 $cm^2$ in the area (size) of each of its measurement electrodes, and was 0.4 cm in the gap between the electrodes, was used. Then, the resistivity was measured by a method in which the carrier resistivity was obtained from electric current which flowed through a circuit while 1 kg of weight was applied to one of the electrodes and a voltage E (V/cm) was applied between the two electrodes. Further, the volume-average particle size of the magnetic particles were measured with the use of a particle size distribution measuring device ("HERO", mfd. by JEOL Ltd.) of the laser diffraction type, and the particle size range of 0.5-350 μm was, based on volume basis, logarithmically divided into 32 decades, and the number of particles in each decade was measured. Then, from the results of the measurement, the median diameter of 50% in volume was used as the volume-average particle size.

Further, the magnetic properties of the magnetic carrier used in this embodiment were measured with the use of an automatic oscillating-field magnetic property recorder ("BHV-30", mfd. by Riken Denshi Co., Ltd.). As a magnetic characteristic value, the magnetization strength of the magnetic carrier was obtained by forming external magnetic fields, which were 795.7 kA/m and 79.58 kA/m, respectively. A sample of the magnetic carrier for measurement was prepared by packing the magnetic carrier in a cylindrical plastic container so as to be sufficiently dense. In this state, the magnetizing moment was measured and further, an actual weight of the sample was weighed to obtain the strength of magnetization (emu/g). Further, the true specific gravity of the magnetic carrier particles was obtained with the use of, e.g., an automatic densitometer of the dry type) ("Accupyc 1330", mfd. by Shimazu Corp.) or the like so that the strength of magnetization per unit volume can be obtained by multiplying the obtained strength of magnetization by the true specific gravity.

In this embodiment, the angle of repose was measured by using the following method.

Measuring apparatus: Powder tester ("PT-N", mfd. by Hosokawa Micron Corp.)

Measuring method: In accordance with measurement of the angle of repose in an operation manual attached to the powder tester (PT-N) (aperture of sieve 301: 710 μm, vibration time: 180 s, amplitude: 2 mm or less)

Figure 6:
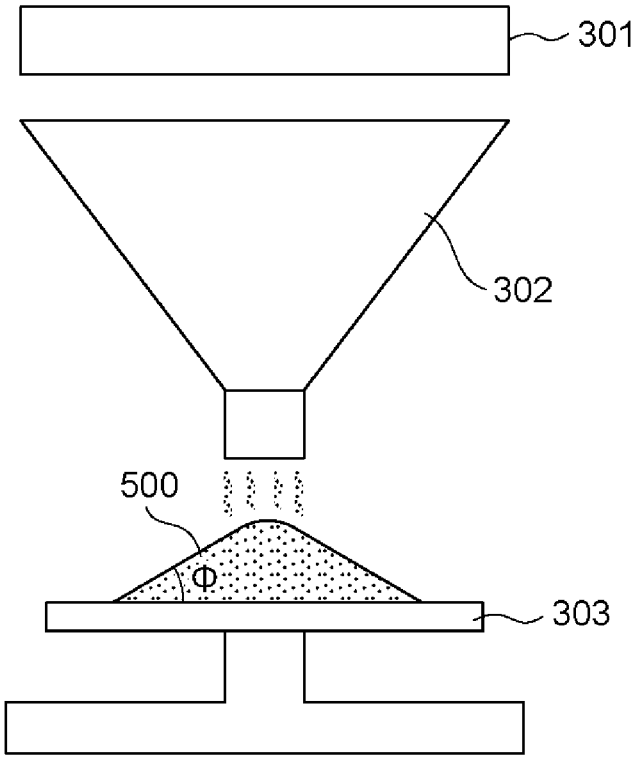
FIG. 6 is a schematic view for illustrating a measuring method of an angle of repose.

As shown in FIG. 6, the two-component developer is dropped from a funnel 302 onto a disk 303, and an angle formed between a generating line of a developer 500 deposited in a conical shape on the disk 303 and the surface of the disk 303 is obtained as the angle of repose. However, the sample is left standing overnight in an environment of 23° C. and a relative humidity of 60% RH and then the angle of repose is measured and repeated five times by the measuring apparatus in the environment of 23° C. and 60% RH. An arithmetic average of the five measured values is used as the angle of repose ϕ.

[Developing Device]

Next, the developing device 1 will be specifically described. FIG. 1 is a sectional view of the developing device in this embodiment. The developing device 1 in this embodiment includes a developing container 2, in which the two-component developer containing the non-magnetic toner and the magnetic carrier is accommodated, and a developing sleeve 8 as a developer carrying member provided in the developing container 2. To the developing sleeve 8, a regulating blade 9 as a developer regulating member (blade member) is provided opposed, and by the regulating blade 9, a layer thickness of the developer carrier on the surface of the developing sleeve 8 is regulated to provide a predetermined amount.

Figure 3:
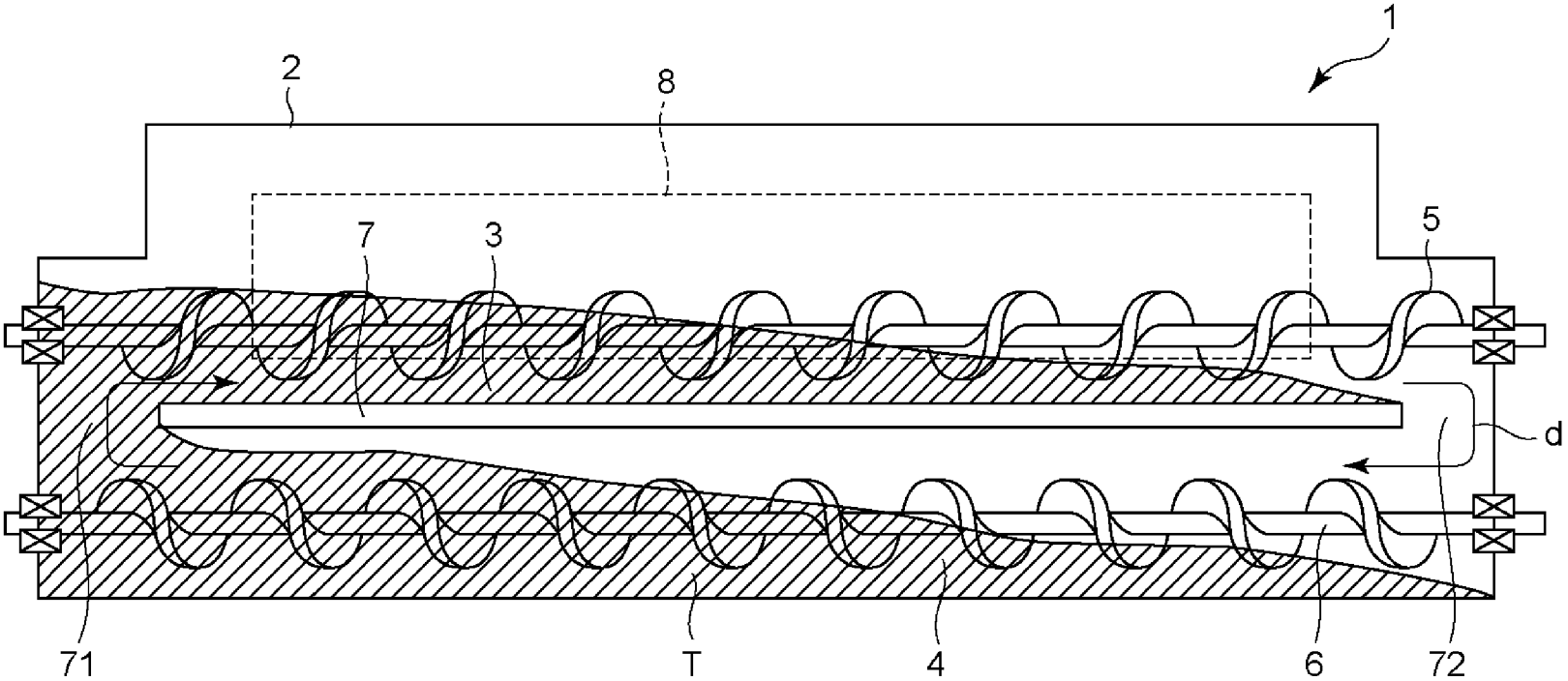
FIG. 3 is a sectional view for illustrating a developing chamber and a stirring chamber in the developing device in Embodiment 1.

Further, the inside of the developing container 2 is vertically partitioned substantially at a central portion into a developing chamber 3 and a stirring chamber 4 by a partition wall 7 which extends in the direction perpendicular to the surface of the drawing sheet of FIG. 1, and the developer is accommodated in the developing chamber 3 and the stirring chamber 4. In the developing chamber 3 and stirring chamber 4, first and second feeding screws 5 and 6 are provided, respectively, as a feeding member for stirring and feeding the developer T. FIG. 3 is a longitudinal sectional view of the developing device 1 for illustrating the developing chamber 3 and the stirring chamber 4 in the developing device 1. The first feeding screw 5 is provided at the bottom of the developing chamber 3 and is substantially parallel to the axial direction (developing device width direction) of the developing sleeve 8. In this embodiment, the first feeding screw 5 has a screw structure in which a blade member formed of a non-magnetic material is provided in a spiral shape around a rotation shaft formed of a ferromagnetic material and is rotated to convey the developer T in the developing chamber 3 along the axial direction of the developing sleeve 8 at the bottom of the developing chamber 3.

Further, also the second feeding screw 6 has, similarly as in the first feeding screw 5, a screw structure in which a blade member threaded in an opposite direction from that of the first feeding screw 5 is provided in a spiral shape around the rotation shaft.

Further, the second feeding screw 6 is provided at the bottom of the stirring chamber 4 and is substantially parallel to the first feeding screw 5, and conveys the developer T in the stirring chamber 4 in a direction opposite from that by the first feeding screw 5 by being rotated in the opposite direction (counterclockwise direction) from the rotational direction (clockwise direction) of the first feeding screw 5.

Thus, by rotation of the first and second feeding screws 5 and 6, the developer is circulated between the developing chamber 3 and the stirring chamber 4. In the develop 1, the developing chamber 3 and the stirring chamber 4 are vertically disposed, so that the developer from the developing chamber 3 toward the stirring chamber 4 are moved from above to below, and the developer from the stirring chamber 4 toward the developing chamber 3 is moved from below to above. Particularly, from the stirring chamber 4 toward the developing chamber 3, the developer is transferred in a manner such that the developer is pushed up (from below to above) by pressure of the developer portion accumulated at an end portion.

Further, the developing container 2 is provided with an opening at a position corresponding to a developing region where the developing container 2 opposes the photosensitive drum 10. At this opening, the developing sleeve 8 is rotatably provided so as to be partly exposed toward the photosensitive drum 10.

In this embodiment the developing sleeve 8 and the photosensitive drum 10 are 20 mm and 80 mm, respectively, in diameter, and the closest distance therebetween is about 300 μm. Setting is made so that the development can be effected in a state in which the developer conveyed by developing sleeve 44 to the developing region (portion) is brought into contact with the photosensitive drum 10.

Incidentally, the developing sleeve 8 is constituted by a non-magnetic material such as aluminum or stainless steel. Inside the developing sleeve 8, a magnet roller 8' is provided in a stationary (non-rotational).

Further, the surface of the developing sleeve 8 is subjected to blasting, so that the developer is caught by an uneven (projection/recess) shape of the surface of the developing sleeve 8 and thus a strong conveying force with respect to a circumferential direction is provided with the rotation of the developing sleeve 8.

The developing sleeve 8 carries the two-component developer regulated in layer thickness by cutting of the chain of the magnetic brush with the regulating blade 9 and is rotated in a direction (counterclockwise direction) indicated by an arrow during the development. Thus, the developing sleeve 8 conveys the developer to the developing region when the developing sleeve 8 opposes the photosensitive drum 10, thus supplying the developer to the electrostatic latent image formed on the photosensitive drum 10 to develop the electrostatic latent image.

The magnet roller 8' provided inside the developing sleeve 8 includes a developing pole S2 and magnetic poles S1, N1, N2 and N3 for conveying the developer. Of these magnetic poles, the N3 pole and the N1 pole are the same in polarity and are provided adjacent to each other. Between these magnetic poles, a repelling magnetic field is formed, so that the magnetic poles are constituted so as to separate the developer T in the stirring chamber 4.

Incidentally, lines in the magnet with respect to a radial direction in FIG. 1 show peak positions of magnetic flux density of the magnetic poles N1, N2, N3, S1 and S2, respectively.

To the developing sleeve 8, a developing bias voltage is the form of a DC voltage biased with an AC voltage is applied from a power source, so that a developing efficiency, i.e., a degree of impartment of the toner to the electrostatic latent image. In this embodiment, the DC voltage of −500 V and the AC voltage of 800 V in peak-to-peak voltage (Vpp) and 12 kHz in frequency (f) were used. However, the DC voltage value and the AC voltage waveform are not limited thereto. Further, in general, in a two-component magnetic brush developing method, when the AC voltage is applied, the developing efficiency is increased and thus the image is high in quality but is rather liable to cause fog. For this reason, the fog is prevented by providing a potential difference between the DC voltage applied to the developing sleeve 8 and a charge potential of the photosensitive drum 10 (i.e., a white background portion potential).

In the developing region, the developing sleeve 8 of the developing device 1 is rotated with the photosensitive drum 10 in the same direction as that of the photosensitive drum 10, and a peripheral speed ratio of the developing sleeve 8 to the photosensitive drum 10 is 1.75. The peripheral speed ratio may be set in a range of 0.5-2.5, preferably 1.0-2.0. When the movement (peripheral) speed ratio is larger, the developing efficiency is correspondingly increased. However, when the ratio is excessively large, problems of toner scattering, developer deterioration and the like occur and therefore the peripheral speed ratio may preferably be set in the above-described ranges.

Further, the regulating blade 9 as the chain cutting member is constituted by a non-magnetic member formed of aluminum or the like in a plate shape extending along a longitudinal axial line direction of the developing sleeve 8, and is provided upstream of the photosensitive drum 10 with respect to the developing sleeve rotational direction. In this embodiment, the regulating blade 9 is constituted by the non-magnetic member, so that the carrier which is the magnetic particles is prevented from being magnetically confined at the blade surface and thus the immobile layer is not formed. In FIG. 1, when on a horizontal surface (plane) passing through the center of the developing sleeve 8, a position in the opposing surface side to the photosensitive drum 10 is 0 degrees, the regulating blade 9 is disposed at a position of 100 degrees from the position of 0 degrees with respect to the clockwise direction. In the following, the magnet arrangement and circumferential positions of the regulating blade 9 or the like relative to the developing sleeve 8 will be described on the clockwise direction basis.

Then, both of the toner and the carrier which constitute the developer pass through the gap between an end of the regulating blade 9 and the developing sleeve 8 to be sent to the developing region. Incidentally, by adjusting the spacing (gap) between the end of the regulating blade 9 and the surface of the developing sleeve 8, a cutting amount of the chain of the magnetic brush of the developer carried on the developing sleeve 8 is regulated, so that the amount of the developer conveyed to the developing region is adjusted. In this embodiment, a coating amount per unit area of the developer on the developing sleeve 8 is regulated at 30 mg/cm$^2$ by the regulating blade 9.

Next, a constitution of a feeding guide relating to motion of the developer, in the upstream side of the regulating blade, which is a characteristic feature portion in this embodiment will be described.

[Feeding Guide Member]

As shown in FIG. 1, the partition member 7 has a shape extended to the neighborhood of the regulating blade 9 and includes a feeding guide 11 as a guiding portion for guiding the developer, accommodated in the developing chamber 3, from above with respect to the direction of gravitation. The feeding guide 11 is provided opposed to the regulating blade 9 in an upstream side with respect to the rotational direction of the developing sleeve 8. The feeding guide 11 (opposing surface to the regulating blade 9) also performs the function of properly supplying the developer through a spacing (gap) between the regulating blade 9 and the feeding guide 11 by drive of the first feeding screw 5. Further, the feeding guide 11 is disposed opposed to the developing sleeve 8 with respect to the circumferential direction of the developing sleeve 8, thus functioning as a regulating portion for regulating a feeding start position P1 of the developer from the developing chamber 3 toward the developing sleeve 8. An angle of a guiding surface of the feeding guide 11 is set at a direction normal to the surface of the developing sleeve 8. Further, the closest distance of the feeding guide 11 to the developing sleeve 8 is set at 1 mm, and the closest position P1 of the developing sleeve 8 to the feeding guide 11 is set at a developing sleeve circumferential position of 130 degrees. Further, a position P3 which is the closest position of the developing sleeve 8 to the partition wall 7 and which is located upstream of the position P1 with respect to the rotational direction of the developing sleeve 8 is constituted so as to be located at a developing sleeve circumferential position of 150 degrees in this embodiment.

Figure 7:
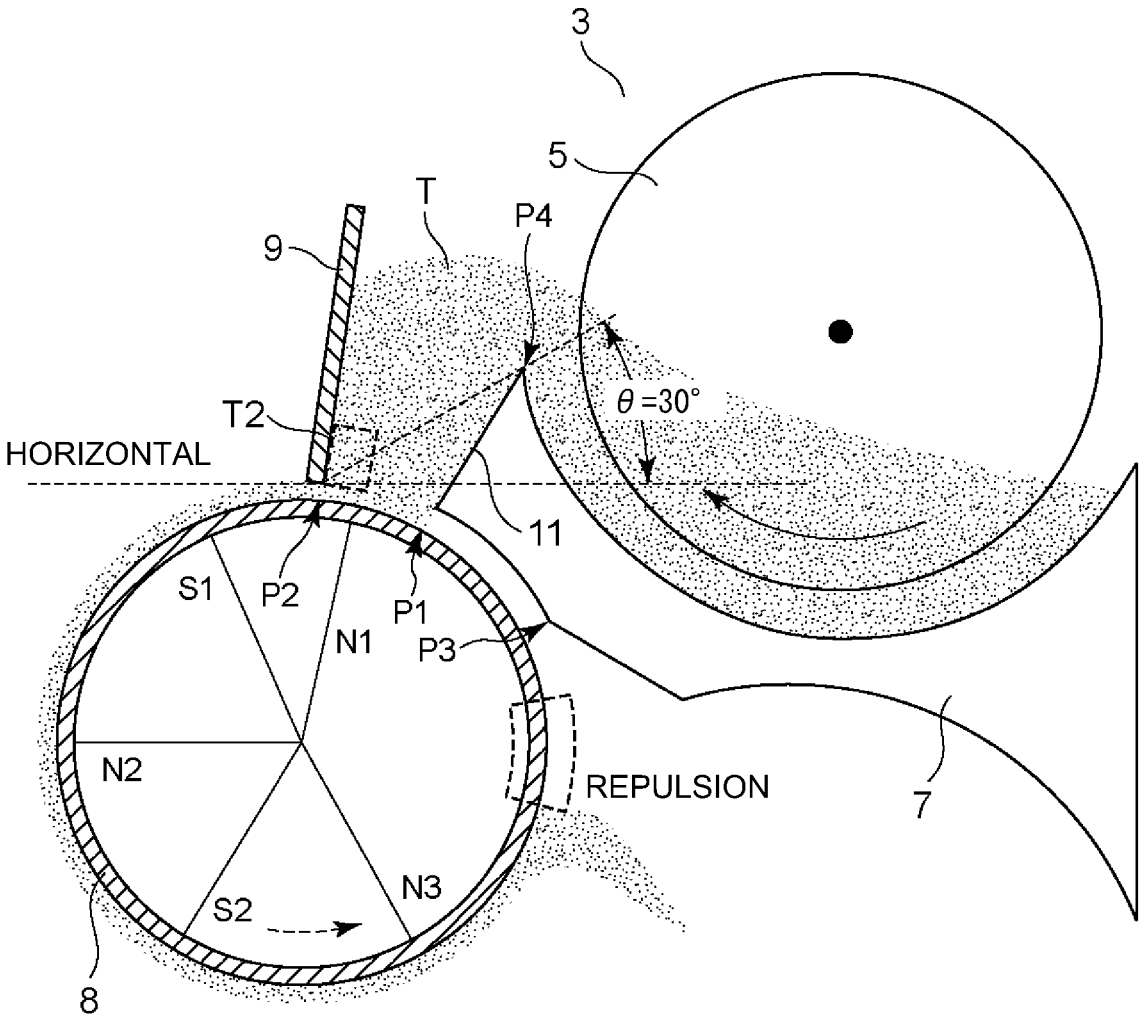
FIG. 7 is a sectional view for illustrating a developing sleeve in the neighborhood of a regulating blade in Embodiment 1.

Next, a flow of the developer in this embodiment will be described with reference to FIG. 7. First, the closest position P3 of the developing sleeve 8 to the feeding guide 11 is located downstream of a repelling region formed by the N1 pole and the N3 pole which are the same in polarity, and the developer receives a force in a direction in which the developer is separated from the developing sleeve 8 by a repulsive force and therefore is removed from the developing sleeve 8 in the repelling region. Accordingly, the developer does not pass through the gap between the developing sleeve 8 and the partition member 7, thus being prevented from being supplied to the regulating blade 9. That is, the developer is supplied to the regulating blade 9 through a path in which the developer from the first feeding screw 5 gets over the feeding guide 11, and then the developer is stored between the regulating blade 9 and the feeding guide 11. In this embodiment, a top position P4 of the feeding guide 11 is set, compared with a position P2 below the regulating blade 9, so that an angle of elevation θ from the horizontal direction is 30 degrees. That is, the top point of the feeding guide 11 is located above, with respect to the horizontal direction, the closest position between the regulating blade 9 and the developing sleeve 8. This is because the developer is stored in the region, between the regulating blade 9 and the developing sleeve 8, in an amount in which the developer is capable of being coated stably.

Further, a length D of the feeding guide 11 is 11 mm. In this embodiment, the feeding guide 11 is constituted integrally with the partition member 7 which partitions the developing chamber 3 and the stirring chamber 4, and is formed of the same material as the developing container 2.

In the present invention, a desirable range of a spacing (developing sleeve circumferential distance) from the regulating blade 9 to the developer feeding start position P1 of the feeding guide 11 is 2 mm or more and 8 mm or less, and is set at about 5 mm in this embodiment.

This is because when the spacing from the regulating blade 9 to the feeding guide 11 is less than 2 mm, a conveying path along which the developer is conveyed becomes narrow and thus there is a possibility of clogging of the developer. On the other hand, when the spacing is excessively large, a contact distance between the developing sleeve 8 and the developer becomes long and thus a rubbing time of the developer by a magnetic force becomes long, so that there is an undesirable possibility of an occurrence of deterioration of the developer.

Incidentally, as in this embodiment, in the case where the first feeding screw 5 is located with respect to a substantially lateral direction of the position of the regulating blade 9, the feeding guide 11 has the functions of conveying/guiding the developer and storing the developer as described above in this embodiment. In addition, the feeding guide 11 has an effect of shielding pressure application to the developer during the drive of the first feeding screw 5. With the drive of the first feeding screw 5, the developer is pressed principally with respect to a screw axis (shaft) direction but the pressure is applied to the developer also with respect to a radius vector direction of the screw. By the pressure with respect to the radius vector direction, in the case where a position relationship between the regulating blade 9 and the first feeding screw 5 is that of the substantially lateral direction, a developer feeding force with respect to the substantially vertical direction is applied to the regulating blade 9, thus being undesirable from the viewpoint of improper coating. Accordingly, also in order to eliminate the influence of the pressure application by the first feeding screw 5, the position of, particularly to the top position P4 (FIG. 7) of the feeding guide 11 may preferably be set at a higher position. The top position P4 of the feeding guide 11 may preferably be located above at least a line connecting the position P2 below the regulating blade 9 and the shaft center of the first feeding screw 5.

Next, as one of characteristic features of this embodiment, the constitution of the developing magnet and magnetic flux density and magnetic force generated by the developing magnet will be described with reference to FIGS. 1, 8 and 9. In this embodiment, the magnetic poles in the magnet roller are constituted so that the magnetic attraction force Fr, applied to the developer having gotten over the feeding guide 11, in the neighborhood of the regulating blade 9 is larger than that in the neighborhood of the feeding guide 11. A mechanism of the present invention will be described later but by employing the above constitution, it is possible to realize a flow of the developer such that the developer supplied between the regulating blade 9 and the feeding guide 11 is attracted toward the surface of the developing sleeve 8. Thus, it is possible to suppress the formation of the immobile layer, in the upstream side of the regulating blade 9, which was conventional problem.

Figure 11:
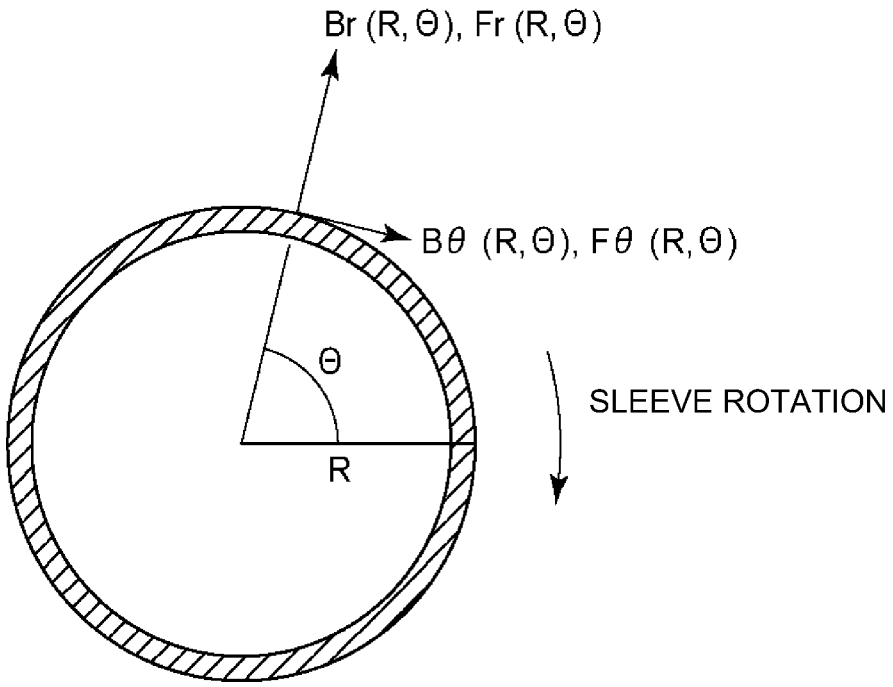
FIG. 11 is a schematic view for illustrating Br, Bθ, Fr and Fθ defined in Embodiment 1.

In this embodiment, Br, Bθ, Fr and Fθ are defined as follows (FIG. 11).

Br: magnetic flux density at a certain point with respect to a direction perpendicular to the developing sleeve surface Bθ: magnetic flux density at a certain point with respect to a direction of a tangential line of the developing sleeve surface Fr: force at a certain point acting in a direction perpendicular to the developing sleeve surface (negative in attraction direction)

Fθ: force at a certain point acting in a direction of a tangential line of the developing sleeve surface (positive in developing sleeve rotational direction)

Unless otherwise specified, Br, Bθ, Fr and Fθ refer to the magnetic flux density or the magnetic force at the certain point on the developing sleeve.

[Magnet Roller]

A constitution of the magnet roller will be specifically described.

The magnet roller 8' in this embodiment has the developing pole N2 and the magnetic poles S1, S2, N1 and N3. Of these magnetic poles, a first magnetic pole N3 and a second magnetic pole N1 which are the same in polarity are provided, adjacent to each other, toward the inside of the developing container 2, and are constituted so that a repelling magnetic field is formed between those magnetic poles N3 and N1 to apply a force from the developing sleeve to the developer in a separation direction thereby to drop the developer into the stirring chamber 4. The second magnetic pole N1 is disposed between the feeding guide 11 and the regulating blade 9. A repelling region formed by the first and second magnetic poles having the same polarity is located at least in the upstream side of the feeding guide 11 with respect to the developing sleeve rotational direction. The first magnetic pole N3 is adjusted to have a peak magnetic flux density of 35 mT and a half-width of 30 degrees, and the second magnetic pole N1 is adjusted to have a peak magnetic flux density of 30 mT and a half-width of 35 degrees.

[Magnetic Field Distribution Between Developing Blade and Feeding Guide]

Figure 8:
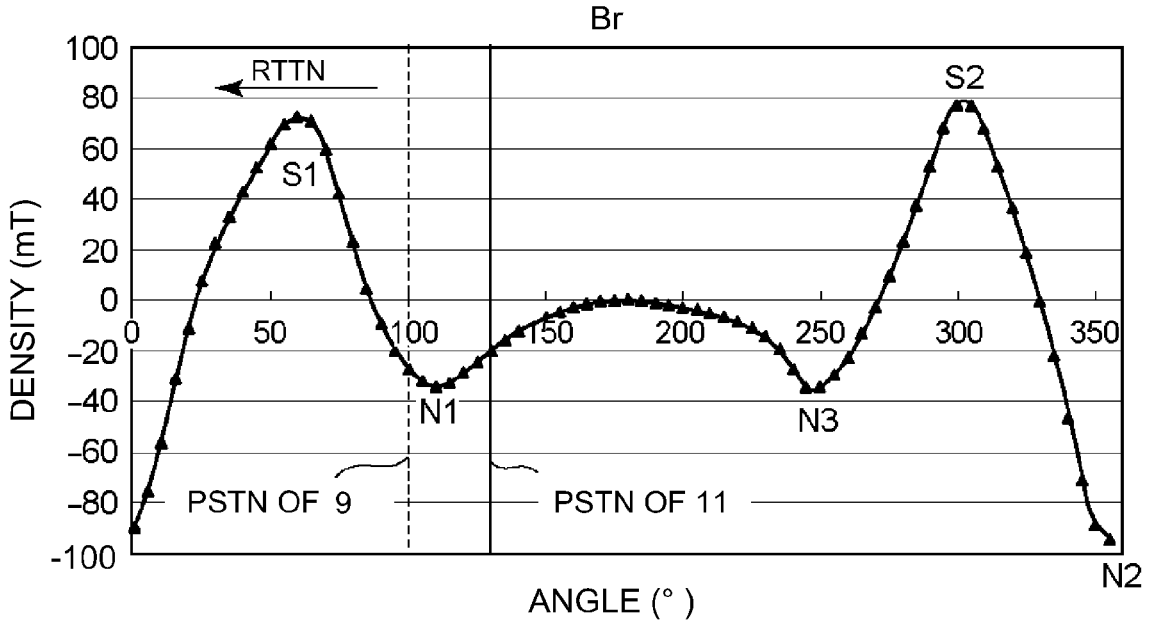
FIG. 8 includes schematic diagrams showing distributions of magnetic flux density Br and magnetic flux density Bθ on a surface of a developing sleeve in Embodiment 1.
Figure 8:
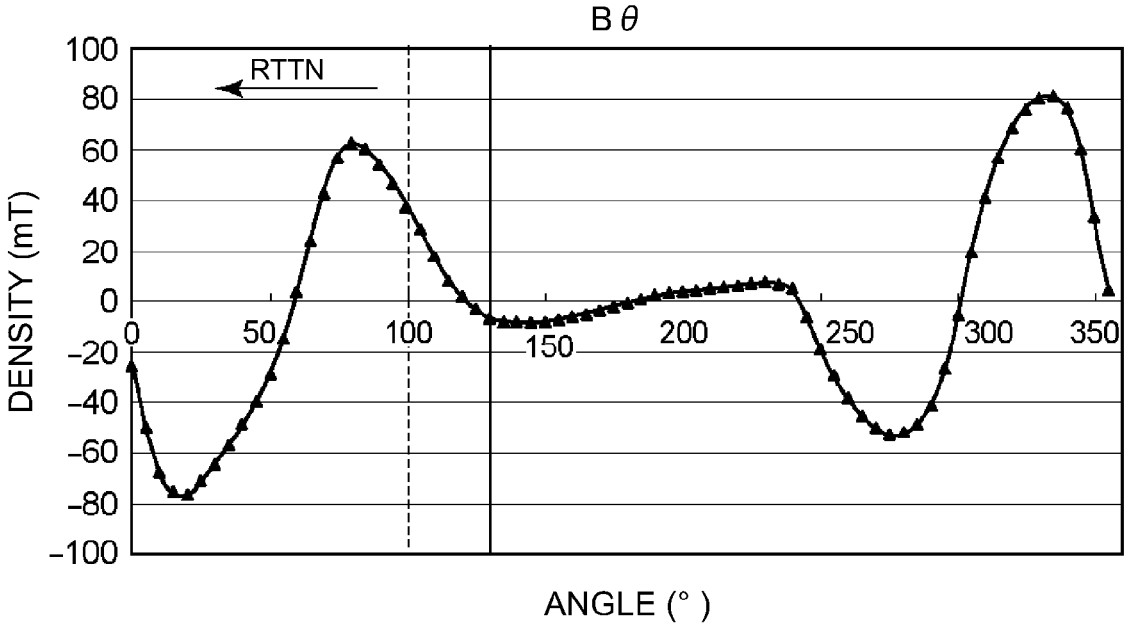
Figure 9:
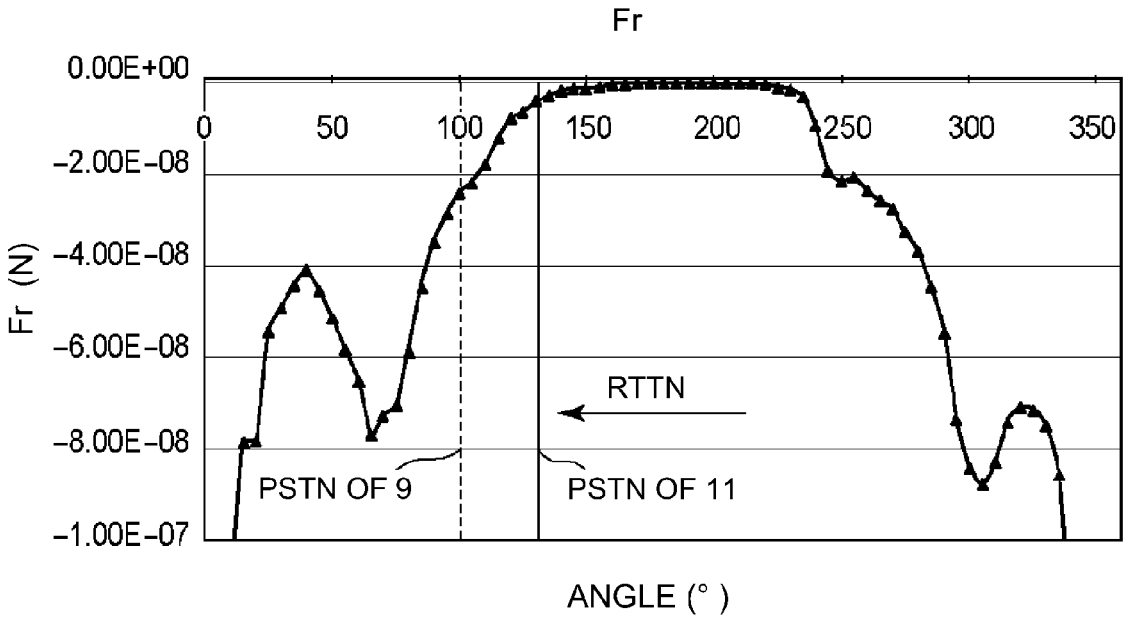
FIG. 9 is a schematic diagram showing a distribution of a magnetic attraction force Fr on the surface of the developing sleeve in Embodiment 1.

With reference to FIGS. 8 and 9, distributions of the magnetic flux densities Br and Bθ and the magnetic force Fr with respect to the normal direction which are formed at the developing sleeve surface by the magnet roller used in this embodiment will be described. The developer is conveyed from right to left in FIGS. 8 and 9, and the regulating blade 9 is disposed at a position of about 100 degrees (broken lines in FIGS. 8 and 9). The feeding guide 11 is disposed at a position of about 130 degrees (solid lines in FIGS. 8 and 9). A negative value of Fr represents that the magnetic force is directed toward the developing sleeve (attraction force direction), and a positive value of Fr represents that the magnetic force is directed in a repulsive force direction. In this embodiment, on the basis of the attraction force direction, an increase and decrease of the magnetic force are described. That is, in the case where a numerical value (absolute value) of the magnetic force is increased, such a state is referred to as an increase of Fr.

In this embodiment, Fr between the position of the feeding guide 11 and the position of the regulating blade 9 is always directed in the attraction force direction, and is constituted so that Fr is abruptly and monotonically increased with a position closer to the regulating blade 9. Fr may preferably be increased monotonically. In this embodiment, the monotonical increase refers to that when Fr is measured with respect to a circumferential direction of the developing sleeve, Fr is monotonically increased in the case where sampling is made in a range of an angle of 2 degrees or more and 10 degrees or less with respect to the developing sleeve circumferential direction.

Further, the magnetic poles are constituted so that at least a positive region (repelling force region) is created in the upstream side of the feeding guide 11 (in the upstream side of the position P3). In this embodiment, a region ranging from the position of about 180 degrees to the position of about 210 degrees is the repelling force region, and the magnetic poles are constituted so that Fr is increased with an increasing distance from the repelling force region toward the downstream side with respect to the developing sleeve rotational direction.

By the magnetic attraction force toward the sleeve direction, when Fr is large, the developer T having gotten over the feeding guide 11 is strongly attracted to the developing sleeve. Accordingly, as shown in FIG. 9, Fr distribution between the feeding guide 11 and the regulating blade 9 is made so that Fr tends to increase monotonically with a position closer to the regulating blade 9. As a result, a developer T2 in the neighborhood of the regulating blade 9 shown in FIG. 7 is attracted to the neighborhood of the developing sleeve 8 with strong Fr compared with the developer located at another position between the regulating blade 9 and the feeding guide 11. In order to realize a flow of the developer in the neighborhood of the regulating blade 9 in an up-down direction (parallel to the regulating blade 9), Fr in the neighborhood of the regulating blade 9 may preferably be large. In this embodiment, Fr between the feeding guide 11 and the regulating blade 9 shows a maximum at an opposing position to the regulating blade 9.

On the other hand, from a viewpoint of weakening a packing state of the developer caused by collision with the regulating blade 9, in order to weaken a developer conveying force along the developing sleeve with rotation of the developing sleeve 8, the sum of Fr between the regulating blade 9 and the feeding guide 11 may preferably be small. The developer conveyance with the rotation of the developing sleeve 8 is effected by a frictional force between the developer and the developing sleeve 8 and therefore, normal reaction, i.e., the magnetic attraction force Fr and the developer conveying force establish a proportional relation. That is, the developer conveying force applied to the regulating blade 9 with respect to the horizontal (left-right) direction is represented by the sum of the developer conveying forces at respective positions between the regulating blade 9 and the feeding guide 11 and therefore is proportional to the sum of Fr between the regulating blade 9 and the feeding guide 11 on the basis of a similar mechanism. Accordingly, in order to weaken the developer conveying force, parallel to the developing sleeve 8, resulting in the formation of the immobile layer by the collision of the developer with the regulating blade 9, it is desirable that the sum of Fr between the regulating blade 9 and the feeding guide 11 is small.

Incidentally, the flow of the developer in the neighborhood of the regulating blade 9 is determined on the basis of a magnitude relationship between the forces of the developer in the neighborhood of the regulating blade 9 with respect to the up-down direction and the left-right direction. Accordingly, in order to realize the flow of the developer in the neighborhood of the regulating blade 9 in the up-down direction, strengthening of the force in the up-down direction by strengthening Fr in the neighborhood of the regulating blade 9 and weakening of the force in the left-right direction by reducing the sum of Fr between the regulating blade 9 and the feeding guide 11 constitute a necessary and sufficient condition. In order to compatibly realize the above two actions, Fr distribution between the regulating blade 9 and the feeding guide 11 may preferably be such that Fr is large only in the neighborhood of the regulating blade 9. In other words, it can be said that it is quantitatively desirable that the Fr distribution between the regulating blade 9 and the feeding guide 11 has a tendency that Fr is abruptly and monotonically increased with a position closer to the regulating blade 9.

An integrated value of Fr from the regulating blade 9 to an upstream position of 2 mm from the regulating blade 9 with respect to the rotational direction of the developing sleeve 8 is defined as FrNear. Further, the sum of Fr obtained by integrating Fr from the position of the regulating blade 9 to the position of the feeding guide 11 is defined as FrAll. In this case, from a result of an explanation described later, it was found that when a ratio of the integrated value FrNear to the integrated value is 60% or more, improper coating is not generated quantitatively. The reason why the integrated value of Fr from the regulating blade 9 to the upstream position of 2 mm from the regulating blade 9 is defined as FrNear is that the region where the developer is compressed and is liable to form the immobile layer is located at an adjacent position ranging from the regulating blade 9 to a position within 2 mm from the regulating blade. That is, the action such that Fr in the region where the developer is liable to be placed in a compression state is limited and thus is kept at a high value and Fr in anther region is lowered (reduction in flow of the developer in the developing sleeve circumferential direction) is effective in preventing the generation of the improper coating.

<Experiment>

An evaluation condition and an evaluation method will be described. In an environmental condition of 45° C., a developing device in which the developer is placed is idled without replacing the developer, so that the presence or absence of the generation of the improper coating is checked by observing a coating state of the developer with eyes. The improper coating phenomenon is, as described above, generated due to hindrance of normal coating by the adhered toner particles deteriorated by rubbing of the developer between the moving (flowing) developer layer and the immobile developer layer. Accordingly, the improper coating is one of phenomena of the toner deterioration, and from such a viewpoint, the improper coating phenomenon is not readily generated when the toner is consumed by image formation and then the toner subjected to rubbing in the developing device is replaced with a new (fresh) toner. From the above mechanism, the improper coating is most liable to occur in the state in which the developing device containing the developer is idled without replacing the developer. Further, the improper coating is generated due to the toner deterioration caused by the rubbing of the developer and therefore the improper coating tends to occur more conspicuously when the temperature is high. For the above-described reasons, the experiment was conducted under a high temperature condition and an idling condition in which the toner is not replaced with the new toner. In the case where the improper coating is not generated at the time of the idling of the developing device for 10 hours, the state is evaluated as "NO I.C." (no generation of the improper coating).

In the experiment, all the developer used had a degree of agglomeration of 60 degrees. This is because a condition in which the improper coating is not generated even with respect to the developer which is most liable to cause the improper coating is sought. Further, in the experiment, in order to enhance a developer conveying property of the developing sleeve, a grooved sleeve subjected to surface grooving was used. The grooved sleeve of 80 μm in depth of groove and 80 in the number of grooves with respect to the circumferential direction of the sleeve was used. In the present invention, the flow of the developer in the neighborhood of the regulating blade in the up-down direction is important and from that viewpoint, a strong sleeve conveying force is disadvantageous. In this experiment, the sleeve having the groove depth of 80 μm which is sufficiently larger than at least the developer carrier diameter of 40 μm is used, and it is preliminarily confirmed that the developer is engaged in the grooves and is conveyed on the sleeve without slipping during developer conveyance, so that such a condition is a condition in which the developer carrying property of the sleeve is highest. This is because the condition in which the improper coating is not generated is sought even in a state in which the developer conveying property of the sleeve is highest.

TABLE 1

| CN*1 | MP*2 | BGD*3 | RATIO*4 | Result |
|---|---|---|---|---|
| 1 | 1 | 3.5 mm | 72% | NO I.C. |
| 2 | | 5.2 mm | 60% | NO I.C. |
| 3 | | 7.8 mm | 56% | I.C. 4*5 |
| 4 | 2 | 5.2 mm | 36% | I.C. 0.5*6 |
| 5 | 3 | 5.2 mm | 48% | I.C. 2*7 |
| 6 | | 4.4 mm | 63% | NO I.C. |
| 7 | | 2.8 mm | 89% | NO I.C. |

*1"CN" is a condition.
*2"MP" is a magnet pattern.
*3"BGD" is a distance between the regulating blade and the feeding guide.
*4"RATIO" is FrNear/FrAll.
*5"I.C. 4" is improper coating generated by idling for 4 hours.
*6"I.C. 0.5" is improper coating generated by idling for 0.5 hour.
*7"I.C. 2" is improper coating generated by idling for 2 hours.

<Result>

Figure 10:
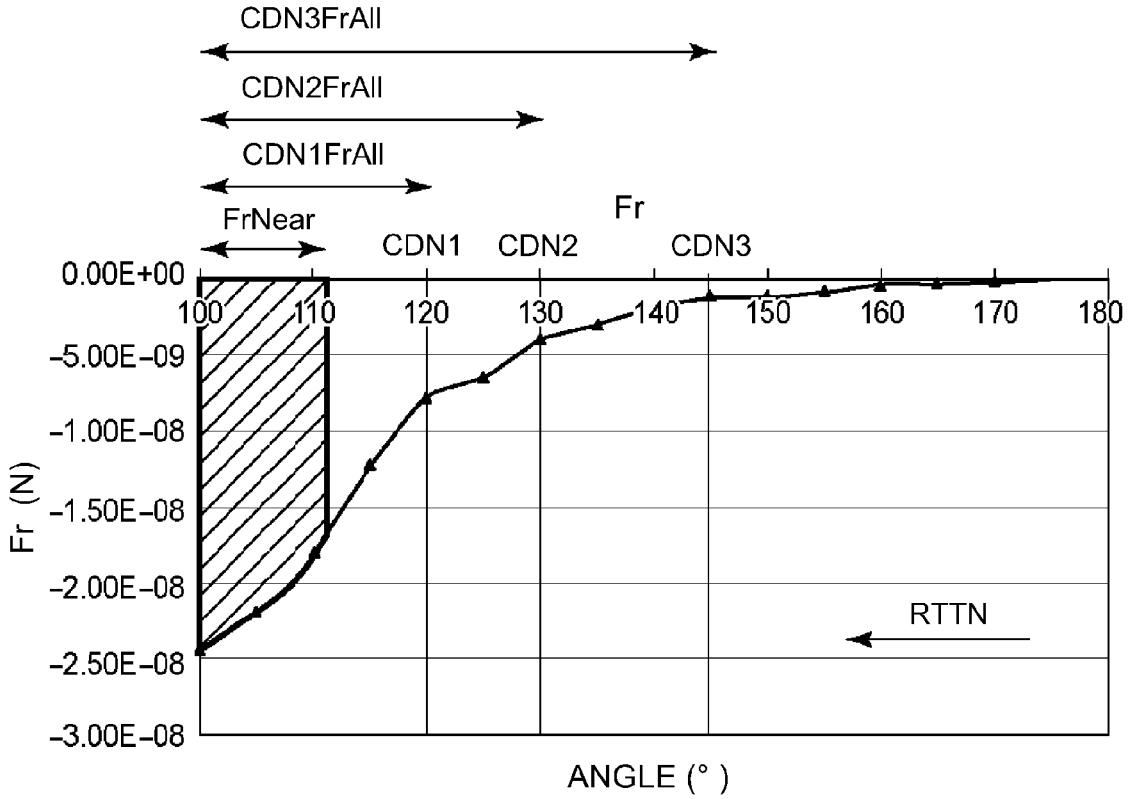
FIG. 10 is a schematic diagram showing a distribution of the magnetic attraction force Fr in the neighborhood of the regulating blade under conditions 1 to 3 in Embodiment 1.

Under conditions 1 to 3, the same magnet pattern 1 is used to make evaluation while fixing the position of the regulating blade 9 but changing the position of the feeding guide 11 at three levels. Incidentally, the feeding guide position under the condition 2 corresponds to that in Embodiment 1. FIG. 10 shows a distribution of the magnet force Fr in the direction normal to the sleeve and a feeding guide position under each of the conditions 1, 2 and 3. From FIG. 10, under each of the conditions 1, 2 and 3, it is understood that the magnet force Fr shows a distribution such that Fr is monotonically and abruptly increased from the position of the feeding guide 11 to the position of the regulating blade 9, and from the above-described mechanism, such that the improper coating is not readily generated in the magnetic force distribution. Incidentally, under the conditions 1 to 3, the position of the regulating blade 9 and the magnet pattern are the same and therefore also the value of FrNear is the same (hatched portion in FIG. 10). However, compared with the condition 1, the distance between the regulating blade 9 and the feeding guide 11 is long under the conditions 2 and 3, and the values of FrAll under the conditions 2 and 3 are correspondingly large. As a result, the ratio (%) of FrNear/FrAll under each of the conditions 2 and 3 is lowered, and specifically is 56% under the condition 3 and is 60% under the condition 2. In this magnetic force distribution, the improper coating is generated at the time of idling for 4 hours under the condition 3 but is not generated under each of the conditions 1 and 2. Thus, it was turned out that at least the ratio of FrNear/FrAll is required to be 60% or more in order to prevent the generation of the improper coating. From a qualitative viewpoint, when the distance between the regulating blade 9 and the feeding guide 11 becomes small (narrow), correspondingly to the distance, FrAll (the sum of Fr) is decreased and thus the developer conveying force with respect to the developing sleeve rotational direction is decreased. As a result, a degree of the flow of the developer in the up-down direction, i.e., the direction perpendicular to the developing sleeve is relatively decreased and therefore it would be considered that the developer located upstream of the regulating blade is readily caused to flow downward.

Figure 15:
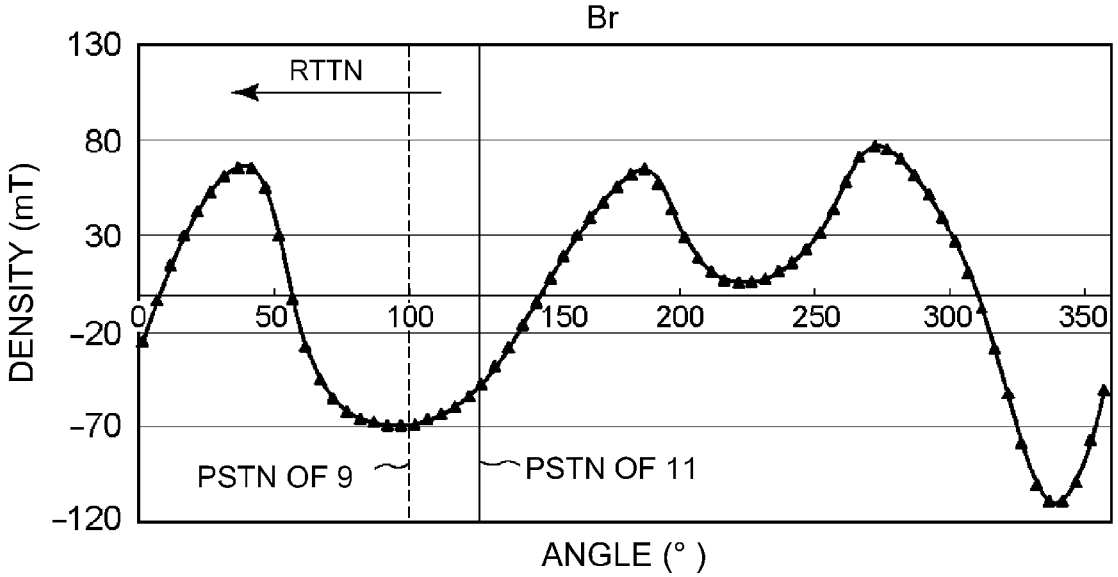
FIG. 15 includes schematic diagrams showing distributions of magnetic flux density Br and magnetic flux density Bθ on a surface of a developing sleeve under condition 4 in Embodiment 1.
Figure 15:
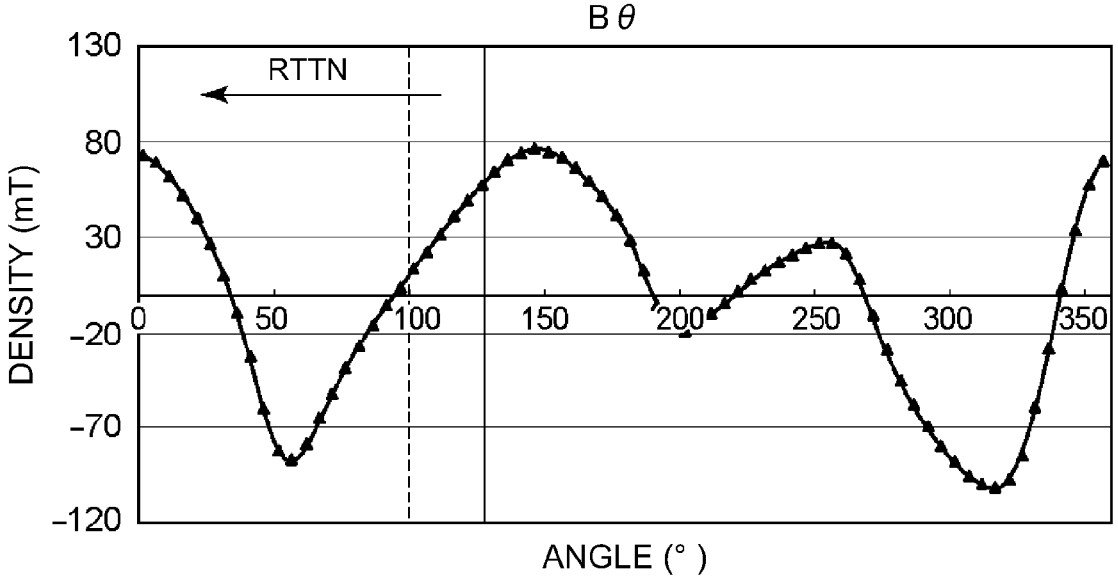
Figure 16:
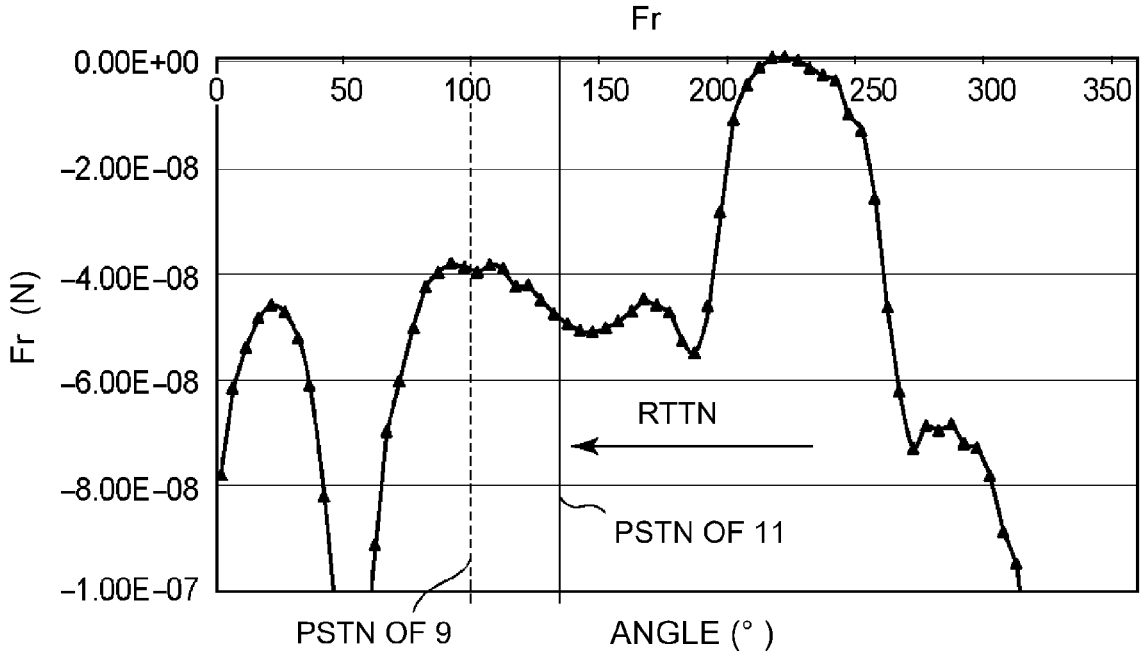
FIG. 16 is a schematic diagram showing a distribution of a magnetic attraction force Fr on the surface of the developing sleeve under condition 4 in Embodiment 1.

As a comparison example, a condition 4 using a magnet pattern different from that in the conditions 1 to 3 will be described. FIGS. 15 and 16 show distributions of magnet flux densities Br and Be acting from the magnet roller in the condition 4 and a distribution of the magnetic force Fr with respect to the direction normal to the sleeve. The negative (−) Fr is directed in the attraction direction to the sleeve, and the positive (+) Fr is directed in the repelling force direction from the sleeve. From FIG. 16, it is understood that Fr between the regulating blade 9 and the feeding guide 11 shows a distribution in which Fr is flat or tends to decrease and thus shows an undesirable distribution in terms of the improper coating on the basis of the mechanism described above. It was qualitatively turned out that FrNear/FrAll has a small value of 36% and the improper coating is generated at the time of the idling for 0.5 hour as a result of continuous idling.

Figure 20:
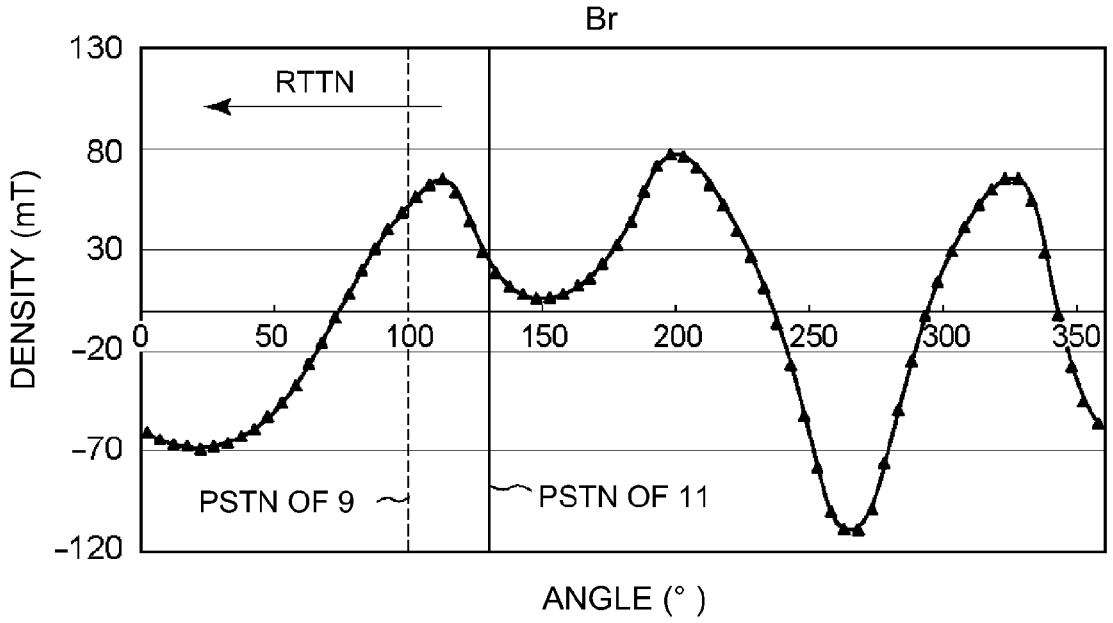
FIG. 20 includes schematic diagrams showing distributions of magnetic flux density Br and magnetic flux density Bθ on a surface of a developing sleeve under conditions 5-7 in Embodiment 1.
Figure 20:
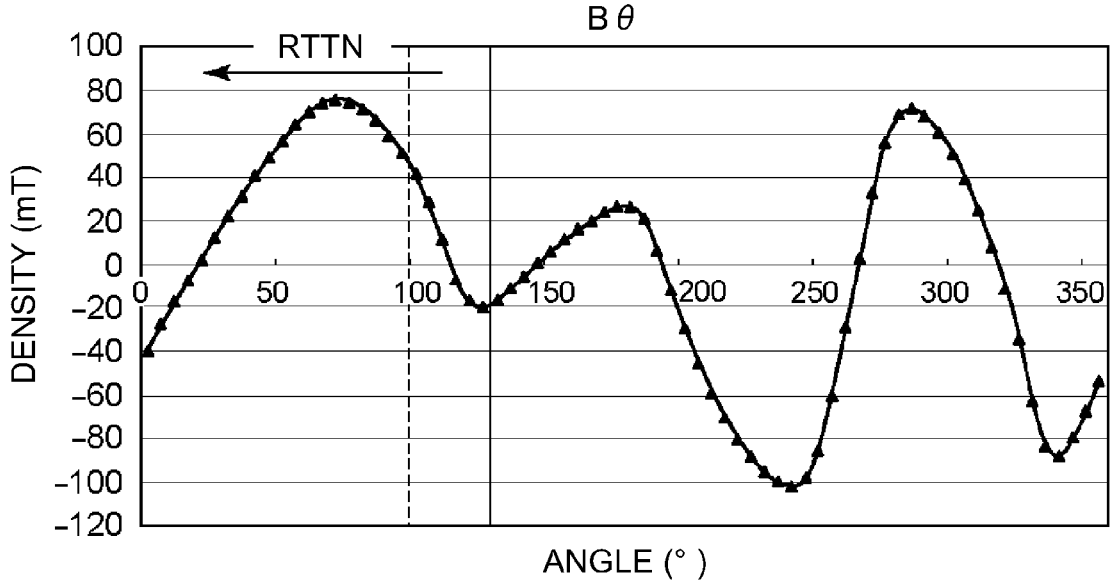
Figure 21:
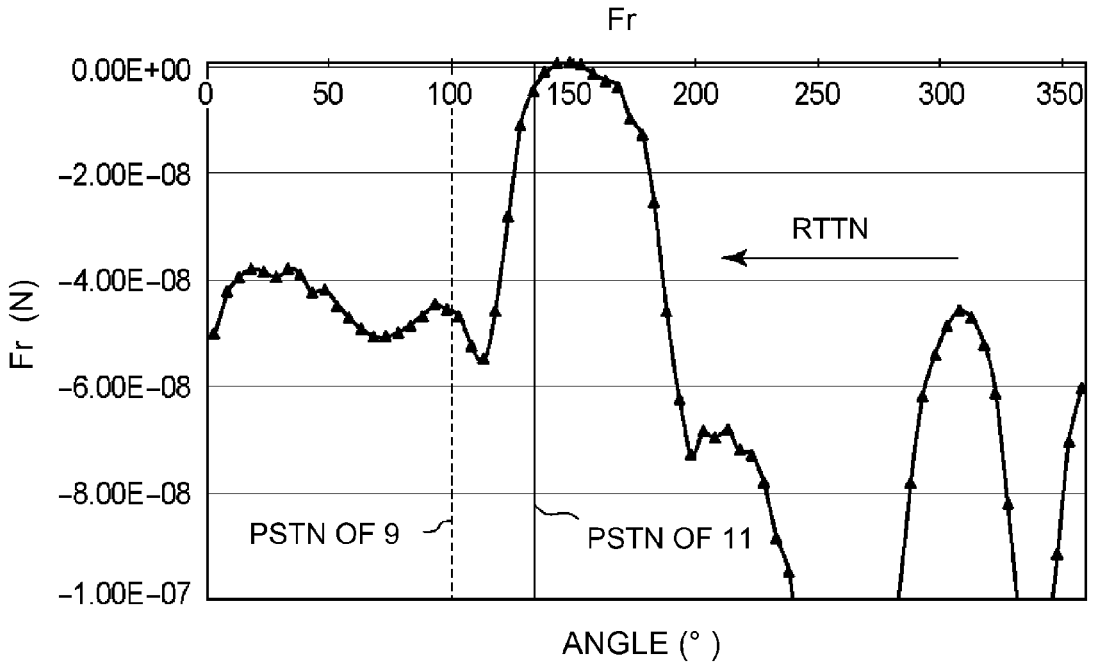
FIG. 21 is a schematic diagram showing a distribution of a magnetic attraction force Fr on the surface of the developing sleeve under conditions 5-7 in Embodiment 1.
Figure 22:
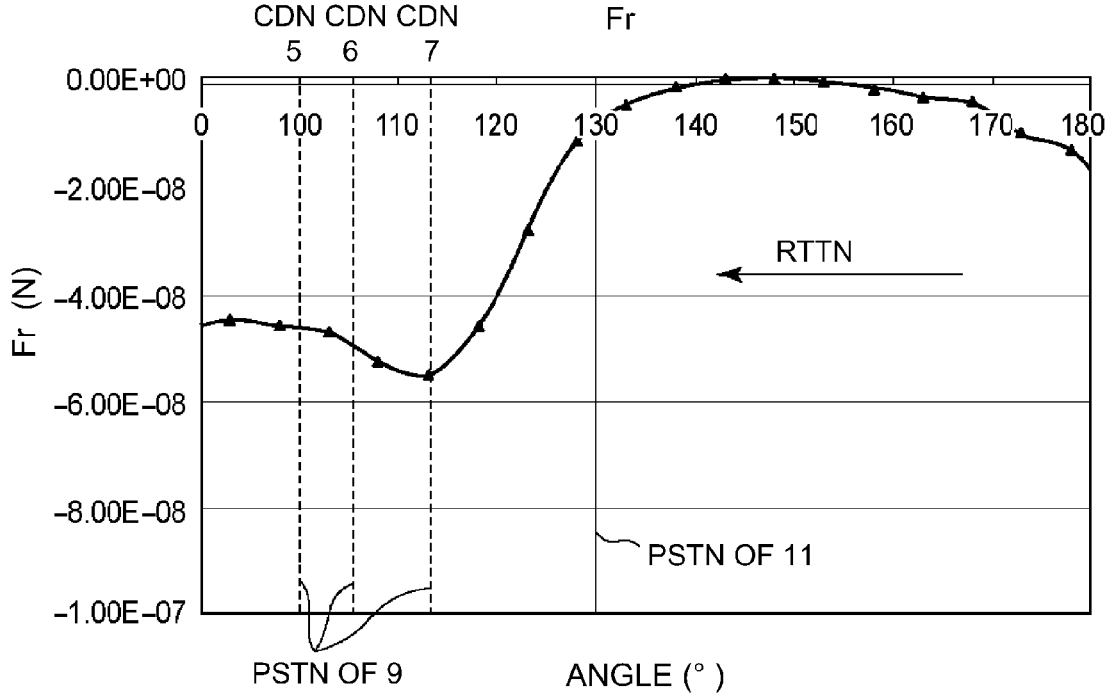
FIG. 22 is a schematic diagram showing a distribution of the magnetic attraction force Fr in the neighborhood of a regulating blade under conditions 5-7 in Embodiment 1.

Next, as a comparison example, conditions 5 to 7 using a magnet pattern 3 different from that in the conditions 1 to 3 will be described. Under the conditions 5 to 7, evaluation is made in such a condition that the position of the feeding guide 11 is fixed but the position of the regulating blade 9 is changed at three levels. FIGS. 20 and 21 show distributions of magnet flux densities Br and Be acting from the magnet roller in the conditions 5 to 7 and a distribution of the magnetic force Fr with respect to the direction normal to the sleeve. The negative (−) Fr is directed in the attraction direction to the sleeve, and the positive (+) Fr is directed in the repelling force direction from the sleeve. From FIG. 21, it is understood that between the regulating blade 9 and the feeding guide 11, Fr tends to increase from the position of the feeding guide 11 toward the neighborhood of the regulating blade 9 but is changed to a tendency to decrease in the neighborhood of the regulating blade 9. In the condition 5, the position of the regulating blade 9 is located at the position when the Fr is changed to the decrease tendency and therefore FrNear/FrAll was 48% which is a value of less than 60%. In the condition 6, compared with the condition 5, the regulating blade develop is shifted toward the feeding guide 11 by about 5 degrees, and the Fr distribution at the position still shows the decrease tendency but Fr at the position is larger than Fr at the position in the condition 5, so that FrNear/FrAll was 64%. In the condition 7, the regulating blade position is located at the peak position of the Fr distribution, and Fr is monotonically and abruptly increased from the feeding guide 11 to the neighborhood of the regulating blade 9 and thus the regulating blade position is a most preferable position, so that FrNear/FrAll in the condition 7 was 89%. As a result of continuous idling, the improper coating was generated in the condition 5 at the time of the idling for 2.5 hours but was not generated in the conditions 6 and 7. That is, also from the conditions 5 to 7, it is understood that FrNear/FrAll is at least required to satisfy 60% or more in order to prevent the generation of the improper coating. Further, setting of the Fr distribution such that Fr between the regulating blade 9 and the feeding guide 11 tends to increase monotonically and abruptly is optimum for realizing the flow of the developer causing no generation of the improper coating. However, it is understood that even in the condition 6 in which there is the Fr decrease region in the neighborhood of the regulating blade 9, when the value of FrNear/FrAll satisfies 60% or more, the improper coating is not generated.

From the above results, according to this embodiment, in order to prevent the improper coating, it is preferable that the Fr distribution between the regulating blade 9 and the feeding guide 11 is made such that Fr is abruptly and monotonically increased in the neighborhood of the regulating blade 9. More quantitatively, the generation of the improper coating can be prevented by setting the ratio of FrNear to FrAll at 60% or more.

Incidentally, in this embodiment, the magnetic pole (cutting pole) closest to the regulating blade 9 may preferably have the magnetic flux density Br of 20 mT or more and 80 mT or less in terms of peak strength (intensity). When the magnetic flux density Br is less than 20 mT, the magnetic attraction force onto the developing sleeve is weaken and therefore there is a possibility that improper developer conveyance is generated. On the other hand, when the magnetic flux density Br exceeds 80 mT, the magnetic force applied to the developer becomes large and therefore developer deterioration becomes problematic.

In this embodiment, a preferable range of Fe is $1\times10^{-8}$ (N) or less. Fθ may preferably be a numerical value not more than ½ of Fr, more preferably be not more than about ¼ of Fr. When Fe is within the range, the effect of the present invention can be obtained at least without being influenced by the flow of the developer.

Further, in this embodiment, a length (11 mm in this embodiment) of the feeding guide 11 is set so that the magnetic attraction force applied to the feeding guide at the top position P4 is made substantially zero. Supply of the developer is effected from the developing chamber 3, and the feeding guide 11 is disposed closer to the developing chamber 3 than the regulating blade 9. For this reason, e.g., when the magnetic attraction force Fr at the feeding guide top position P4 is large, the developer in the developing chamber 3 receives the magnetic attraction force at the top position P4 of the feeding guide 11 and thus is attracted downward, and therefore an amount of the developer which reaches the neighborhood of the regulating blade 9 shown in FIG. 7 is decreased. As a result, even when the Fr distribution such that Fr is large in the neighborhood of the regulating blade 9 is formed, the amount of the developer in the neighborhood of the regulating blade 9 is small and therefore the supply of the developer along the regulating blade 9 with respect to the up-down direction is decreased, so that the nip-down flow of the developer parallel to the regulating blade 9 it not readily generated. Accordingly, it is preferable that the feeding guide top position is located away from the developing sleeve (amount) so that the magnetic attraction force at the top position of the feeding guide 11 becomes substantially zero.

Further, in this embodiment, at least the developing sleeve 8 may preferably be located below, with respect to the vertical direction, the feeding guide 11 at the developing sleeve closest position to the feeding guide 11. The magnetic attraction force Fr at the feeding guide position tends to become small as a feature in this embodiment, and in the case where the magnetic attraction force Fr is extremely small, there is a possibility that the developer vertically drops by gravitation through the gap between the feeding guide 11 and the developing sleeve 8. For this reason, it is preferable that a constitution in which the developing sleeve receives the developer at the position below the gap so as to convey the dropped developer is employed.

In the following, a method for realizing the Fr between showing the abruptly monotonical increase tendency with a distance close to the regulating blade (i.e., a method for realizing the ratio of the integrated value (FrNear) to the integrated value (FrAll) of 60% or more) will be described. In this embodiment, at the position of the feeding guide 11, the magnetic flux density is small between the repelling magnetic poles N1 and N3 and a gradient of the change in magnetic flux density Br between the N1 and N3 magnetic poles is moderate. On the other hand, with respect to the direction from the feeding guide 11 to the regulating blade 9, the N1 pole having a medium magnetic flux density and the S1 pole having a large magnetic flux density are located and therefore the gradient of the magnetic flux density change tends to become large. Accordingly, the magnetic flux density gradient is made to show the increase tendency with the distance closer to the neighborhood of the regulating blade 9 from the neighborhood of the feeding guide 11, so that the magnetic force (Fr) proportional to the gradient of the square of the magnetic flux density can be similarly made to show the abrupt increase tendency.

Further, e.g., by locating the S1 pole, downstream of the N1 pole provided upstream of the regulating blade 9, closer to the N1 pole, the gradient of the magnetic flux density between the N1 pole and the S1 pole becomes large, so that the Fr distribution shows further abruptly increasing tendency.

Further, e.g., the abrupt increase tendency of the Fr distribution is realized by decreasing the half width of the N1 pole in the upstream side of the regulating blade 9 and by decreasing the half width of the S1 pole.

Further, e.g., by increasing the peak value of the magnetic flux density of the S1 pole in the downstream side of the regulating blade 9, the gradient of the magnetic flux density between the N1 and S1 poles and therefore the Fr distribution shows further abruptly increasing tendency.

In summary, in order to provide a magnet pattern by which the Fr distribution in such that Fr is abruptly increased, the magnetic poles may be basically constituted in the following manner. That is, the magnetic force of the magnetic pole S1, located immediately downstream of the cutting pole (the magnetic pole closest to the blade in the upstream side of the sleeve) N1, acting on the cutting pole N1 may only be required to be relatively increased.

<Measuring Method of Magnetic Force/Magnetic Flux Density>

A measuring method of the magnetic force in the present invention will be described.

The magnetic force described in this embodiment will be calculated by a calculating method described below.

The magnetic force acting on the magnetic carrier is represented by the following formula:

$$\vec{F} = \frac{\mu - \mu_0}{\mu_0(\mu + 2\mu_0)} 2\pi b^3 \nabla B^2$$

$\mu_0$ = SPACE PERMEABILITY
$\mu$ = PERMEABILITY OF CARRIER
$b$ = RADIUS OF CARRIER
$B$ = MAGNETIC FLUX DENSITY

Therefore, the following formula is obtained.

$$\begin{aligned} \vec{F} &\propto \nabla B^2 \\ &= \frac{\partial}{\partial r}(Br^2 + B\theta^2)\vec{e}_r + \frac{1}{r}\frac{\partial}{\partial\theta(B_r^2 + B_\theta^2)}\vec{e}_\theta \\ \therefore \vec{F} &\propto \underbrace{\left(B_r\frac{\partial B_r}{\partial r} + B_\theta\frac{\partial B_\theta}{\partial r}\right)\vec{e}_r}_{Fr} + \underbrace{\frac{1}{r}\left(B_r\frac{\partial B_r}{\partial\theta} + B_\theta\frac{\partial B_\theta}{\partial\theta}\right)\vec{e}_\theta}_{F\theta} \end{aligned} \quad (1)$$

Therefore, when Br and Bθ are known, Fr and Fθ can be obtained. Here, the magnetic flux density Br is measured by using, as a measuring device, a magnetic field measuring device ("MS-9902" (trade name), mfd. by F.W. BELL, Inc.). The magnetic flux density Br is measured by setting a distance between a probe, which is a member of the measuring device, and the surface of the developing sleeve 8 at about 100 μm.

Further, Bθ can be obtained in the following manner. Vector potential $A_Z$ (R, θ) at a measuring position of the magnetic flux density Br is obtained by using the measured magnetic flux density Br according to the following formula.

$$A_z(R, \theta) = \int_0^\theta RBrd\theta$$

Under a boundary condition of $A_Z$ (R, θ), $A_Z$ (R, θ) is obtained by solving the following equation.

$$\nabla^2 A_Z(R,\theta)=0$$

Then, Bθ can be obtained from the following equation.

$$B_\theta = -\frac{\partial A_z(r, \theta)}{\partial r}$$

Br and Bθ measured and calculated in the above-described manner are applied to the above formula (1), so that Fr and Fθ can be derived.

Figure 4:
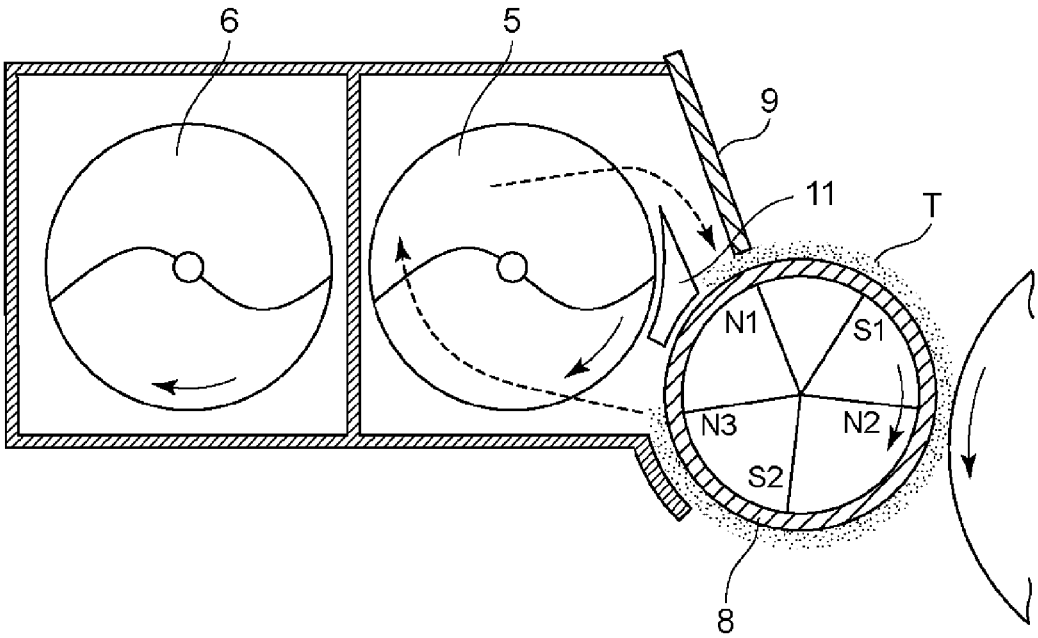
FIG. 4 is a sectional view for illustrating a horizontal stirring type developing device in Embodiment 1.
Figure 5:
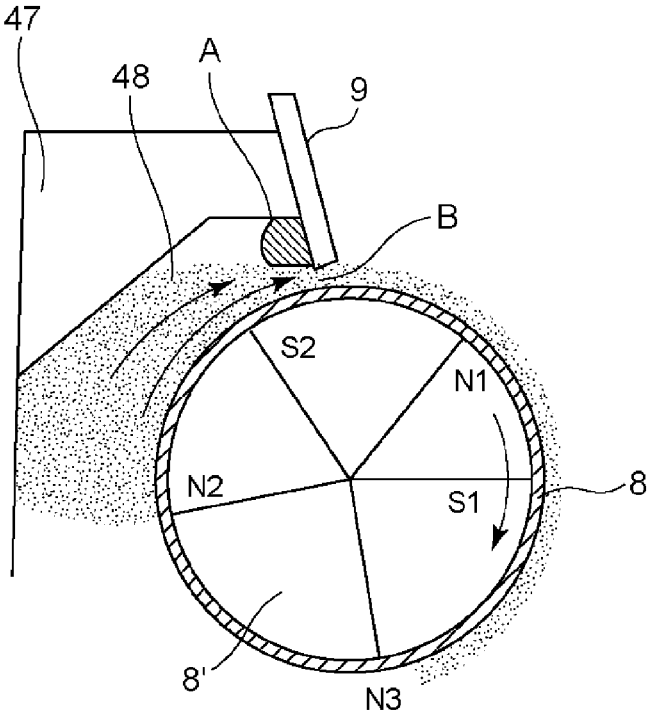
FIG. 5 is a sectional view for illustrating a developer state in an upstream side of a regulating blade in a conventional developing device.

In this embodiment, the constitution of the developing device was described by taking the vertical stirring type developing device, as an example, in which the developing chamber 3 and the stirring chamber 4 are vertically disposed. However, the present invention is also applicable to a developing device of another type, such as a developing device in which the developing chamber and the stirring chamber are horizontally provided as shown in FIG. 4. That is, a similar effect can be obtained when there is no feeding of the developer from the upstream side of the feeding guide 11, the developer is supplied from the position at least higher than the closest position between the regulating blade and the developing sleeve, and the above-described magnetic force distribution is formed between the feeding guide and the regulating blade.

Further, in the present invention, even when magnetic susceptibility of the carrier used is changed, the similar effect can be obtained. For example, when the carrier having a small magnetic susceptibility is used, the magnetic force acting from the magnet roller is relatively lowered but both of FrNear and FrAll are relatively lowered, and therefore it would be considered that the ratio which is the quotient of FrNear divided by FrAll is not influenced by the small magnetic susceptibility since the lowering of FrNear and the lowering of FrAll are canceled. Also with respect to the carrier having a large magnetic susceptibility, on the basis of a similar mechanism, the ratio of FrNear/FrAll is not influenced by the large magnetic susceptibility.

Embodiment 2

Figure 14:
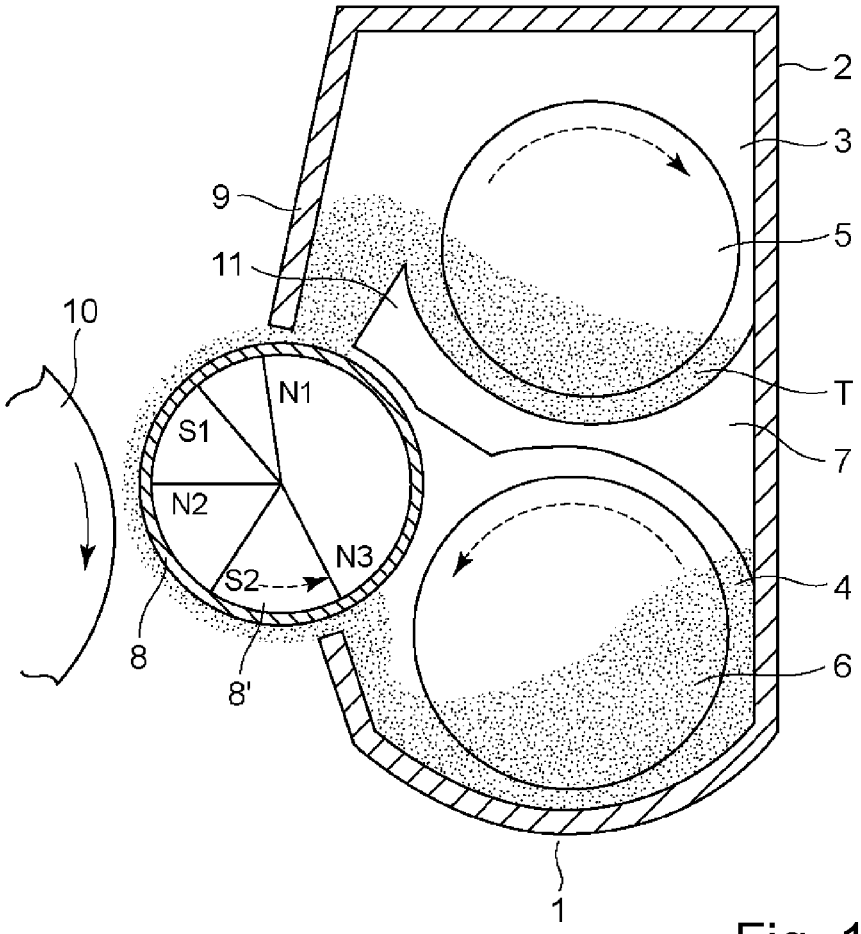
FIG. 14 is a schematic view for illustrating an arrangement of magnetic poles particularly with respect to a regulating blade of a developing device 2.

A basic constitution of an image forming apparatus in this embodiment is the same as that in Embodiment 1 and therefore description of a general structure of the image forming apparatus will be omitted. In Embodiment 1, the second magnetic pole N1 was disposed between the feeding guide 11 and the regulating blade 9. On the other hand, in this embodiment, as shown in FIG. 14, the second magnetic pole N1 is provided downstream of the regulating blade 9 with respect to the sleeve rotational direction. As described in Embodiment 1, in the present invention, the Fr distribution and the arrangement of the regulating blade 9 and the feeding guide 11 are important, and the present invention is not influenced directly by the peak position itself of the magnetic flux density. Incidentally, the position of the feeding guide 11 was set similarly as in Embodiment 1.

Figure 12:
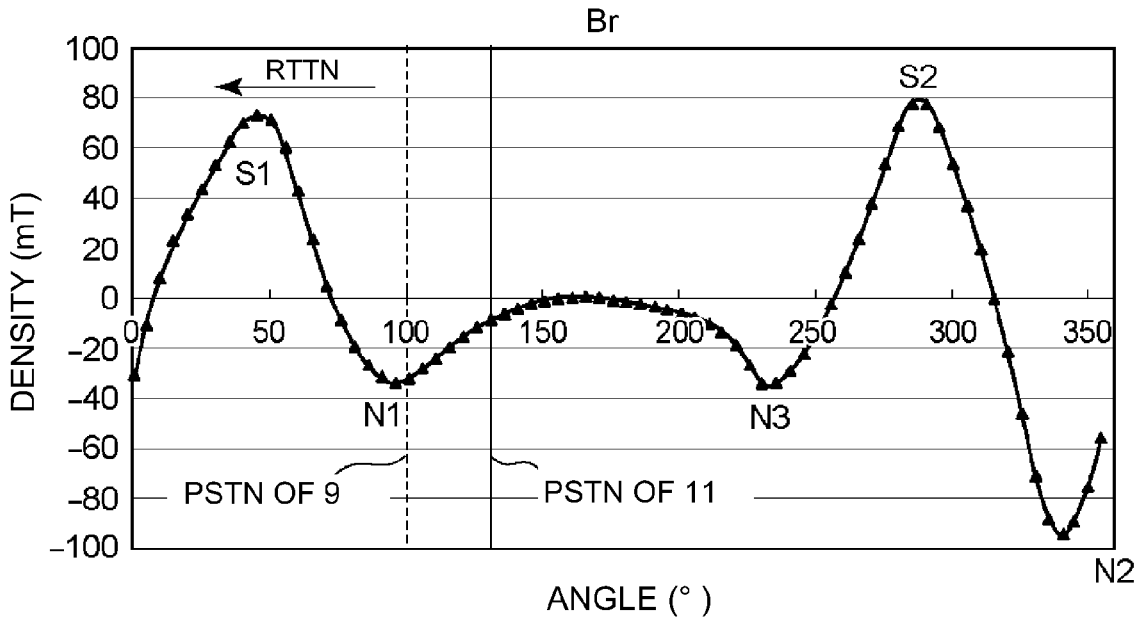
FIG. 12 includes schematic diagrams showing distributions of magnetic flux density Br and magnetic flux density Bθ on a surface of a developing sleeve in Embodiment 2.
Figure 12:
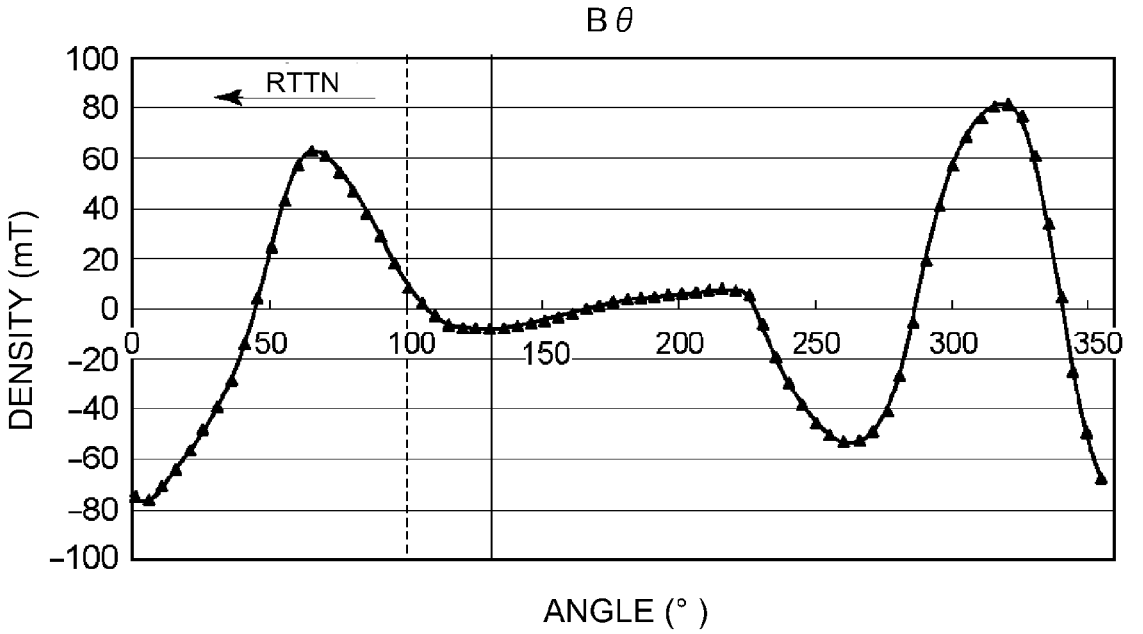
Figure 13:
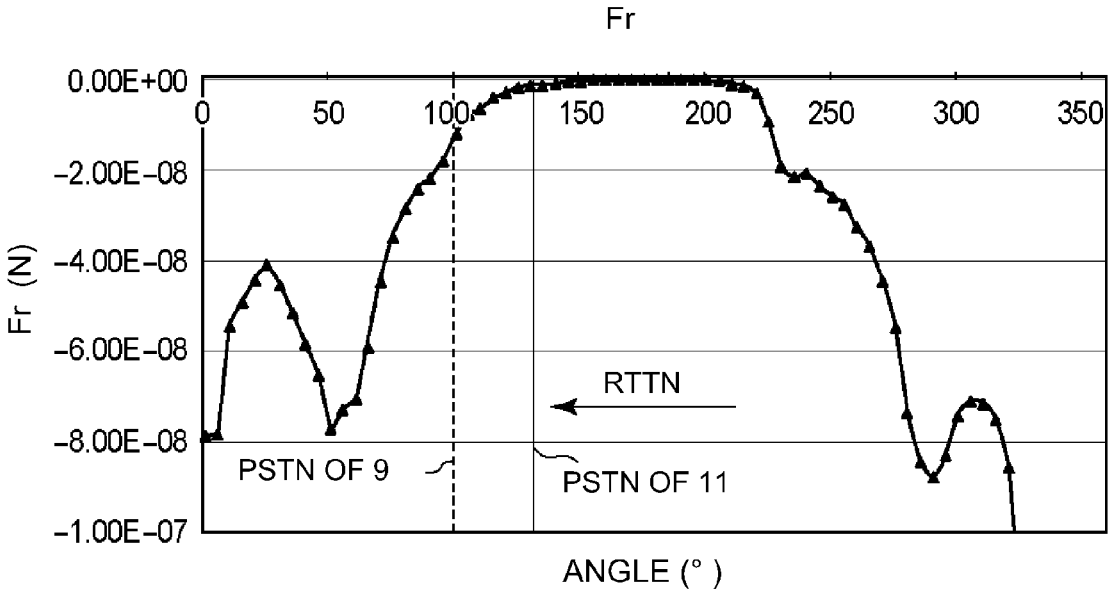
FIG. 13 is a schematic diagram showing a distribution of a magnetic attraction force Fr on the surface of the developing sleeve in Embodiment 2.

Next, with reference to FIGS. 12 and 13, the magnetic flux density Br and the magnetic force Fr, with respect to the direction normal to the sleeve, which acts from the magnet pattern 4 used in this embodiment will be described. In FIGS. 12 and 13, the developer is conveyed from right to left, and the regulating blade 9 is disposed at the position of 100 degrees similarly as in Embodiment 1 (broken lines in FIGS. 12 and 13). The negative (−) Fr is directed in the attraction force direction to the sleeve, and the positive (+) Fr is directed in the repelling force direction from the sleeve. In this embodiment, as shown in FIG. 14, the second magnetic pole N1 is disposed downstream of the regulating blade 9 with respect to the sleeve rotational direction, so that the pattern of the magnetic flux density Br is different from that in Embodiment 1.

However, as shown in FIG. 13, also in this embodiment, Fr between the feeding guide 11 and the regulating blade 9 is always directed in the attraction force direction and is constituted so as to be increased with a position closer to the regulating blade 9. The feeding guide 11 is disposed at a position of about 130 degrees (FIGS. 12 and 13). Further, in the upstream side of the feeding guide 11, the magnetic poles are constituted so that at least Fr is in the positive region (repelling force direction). In this embodiment, the positions from about 160 degrees to about 190 degrees constitute the repelling force region, and a constitution in which Fr is increased from the repelling force region toward a downstream side with respect to the developing sleeve rotational direction is employed. That is, similarly as in Embodiment 1, the Fr distribution having the increase tendency such that Fr is increased from the feeding guide 11 toward the regulating blade 9 is shown.

Similarly as in Embodiment 1, in the environmental condition of 45° C., the result of execution of the continuous idling of the developing device containing the developer without replacing the developer with the new developer is shown in Table 2.

TABLE 2

| CN*1 | MP*2 | BGD*3 | RATIO*4 | Result |
|---|---|---|---|---|
| 1 | 1 | 3.5 mm | 72% | NO I.C. |
| 2 | | 5.2 mm | 60% | NO I.C. |
| 3 | | 7.8 mm | 56% | I.C. 4*5 |
| 4 | 2 | 5.2 mm | 36% | I.C. 0.5*6 |
| 5 | 3 | 5.2 mm | 48% | I.C. 2*7 |
| 6 | | 4.4 mm | 63% | NO I.C. |
| 7 | | 2.8 mm | 89% | NO I.C. |
| 8 | 4 | 5.2 mm | 64% | NO I.C. |

*1"CN" is a condition.
*2"MP" is a magnet pattern.
*3"BGD" is a distance between the regulating blade and the feeding guide.
*4"RATIO" is FrNear/FrAll.
*5"I.C. 4" is improper coating generated by idling for 4 hours.
*6"I.C. 0.5" is improper coating generated by idling for 0.5 hour.
*7"I.C. 2" is improper coating generated by idling for 2 hours.

<Result>

Condition 8 shows the result of Embodiment 2. In the condition 8, the ratio of FrNear/FrAll was 64%, and as the result of the continuous idling, it was turned out that the improper coating was not generated.

Incidentally, as shown in FIGS. 12 and 14, the magnetic pole arrangement in this embodiment is substantially the same as that in Embodiment 1 except that the magnetic flux density peak position of the N1 pole is located downstream of the regulating blade 9 with respect to the developing sleeve rotational direction. That is, the magnetic flux density is small between the repelling poles of the N1 and N3 poles, and the gradient of the magnetic flux density Br between the N1 and N3 magnetic poles is moderate. The magnetic poles are constituted so that the N1 pole having the magnetic flux density of a medium degree is located toward the downstream side of the regulating blade 9 and the S1 pole having the large magnetic flux density is disposed adjacent to and downstream of the N1 pole, and therefore the gradient of the magnetic flux density between the N1 and S1 poles tends to become large. Accordingly, the gradient of the magnetic flux density tends to abruptly increase with a position from the position of the feeding guide 11 closer to the neighborhood of the regulating blade 9, so that Fr which is proportional to the gradient of the square of the magnetic flux density. Accordingly, Fr between the regulating blade 9 and the feeding guide 11 shows substantially the same distribution as that in Embodiment 1 and therefore an effect similar to that in Embodiment 1 is obtained.

Specifically, in this embodiment, the N1 pole is disposed downstream of the position of the regulating blade 9 with respect to the developing sleeve rotational direction and therefore compared with Embodiment 1, the gradient of the increase in the neighborhood of the regulating blade 9 is somewhat abrupt. As a result, the ratio of FrNear to FrAll is increased by 4% (difference between those in conditions 2 and 8). In Embodiment 1, the magnetic flux density peak position of the N1 pole is located upstream of the regulating blade 9 and therefore the magnetic flux density gradient in the neighborhood of the peak position becomes small, with the result that a degree of the increase of Fr which is proportional to the square of the change gradient of the magnetic flux density also tends to become gradual.

As described above, in Embodiment 2, even when the magnet pattern different from that in Embodiment 1 is used, the Fr distribution between the regulating blade 9 and the feeding guide 11 can be made to show the abrupt and monotonic increase tendency in the neighborhood of the regulating blade 9. In addition, it is possible to prevent the generation of the improper coating by setting the ratio of FrNear to FrAll at 60% or more.

Embodiment 3

Figure 17:
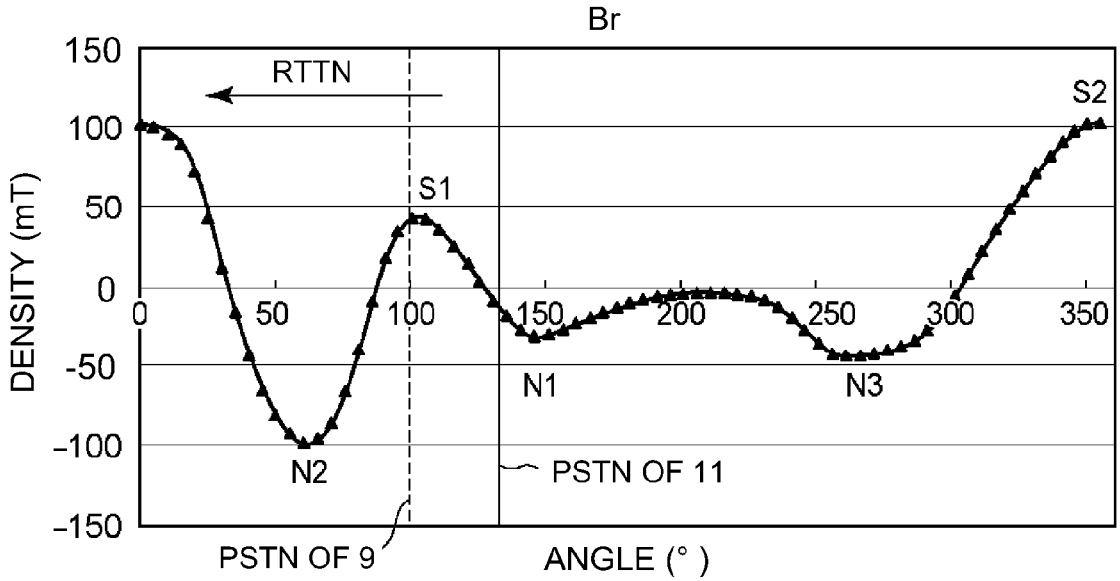
FIG. 17 includes schematic diagrams showing distributions of magnetic flux density Br and magnetic flux density Bθ on a surface of a developing sleeve in Embodiment 3.
Figure 17:
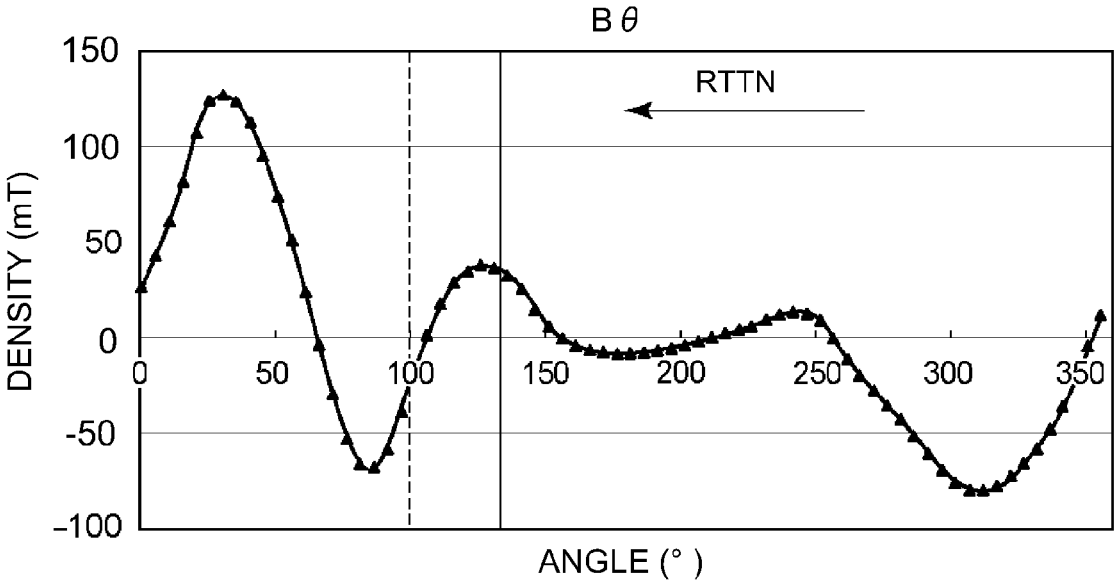
Figure 19:
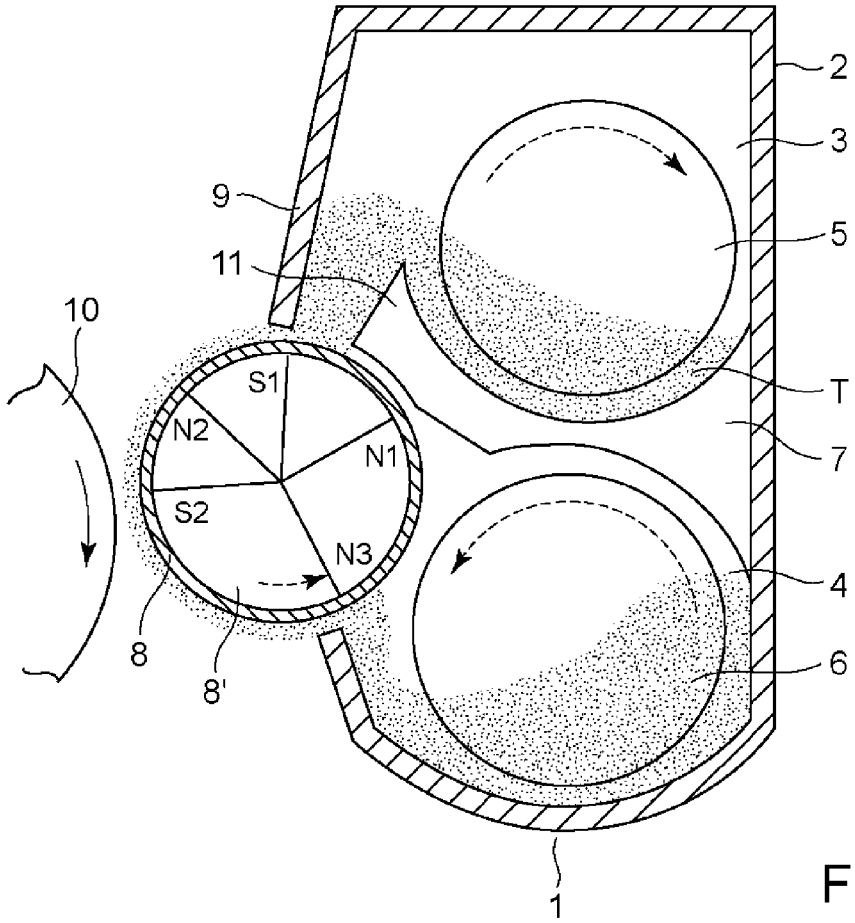
FIG. 19 is a schematic view for illustrating an arrangement of magnetic poles particularly with respect to a regulating blade of a developing device in Embodiment 3.

A basic constitution of an image forming apparatus in this embodiment is the same as that in Embodiment 1 and therefore description of a general structure of the image forming apparatus will be omitted. In Embodiment 1, of the N1 and N3 poles having the same polarity, the developing sleeve rotational direction downstream-side N1 pole was disposed in the neighborhood of the upstream side of the regulating blade 9. On the other hand, in this embodiment, as shown in FIGS. 17 and 19, the S1 pole which is not the magnetic pole (N1) having the same magnetic polarity as that of the N3 pole is disposed in the neighborhood of the regulating blade 9 in the upstream side. As described in Embodiment 1, in the present invention, the Fr distribution and the arrangement of the regulating blade 9 and the feeding guide 11 are important, and the present invention is not influenced directly by the arrangement itself of the magnetic poles. Incidentally, the position of the feeding guide 11 was set similarly as in Embodiment 1.

Figure 18:
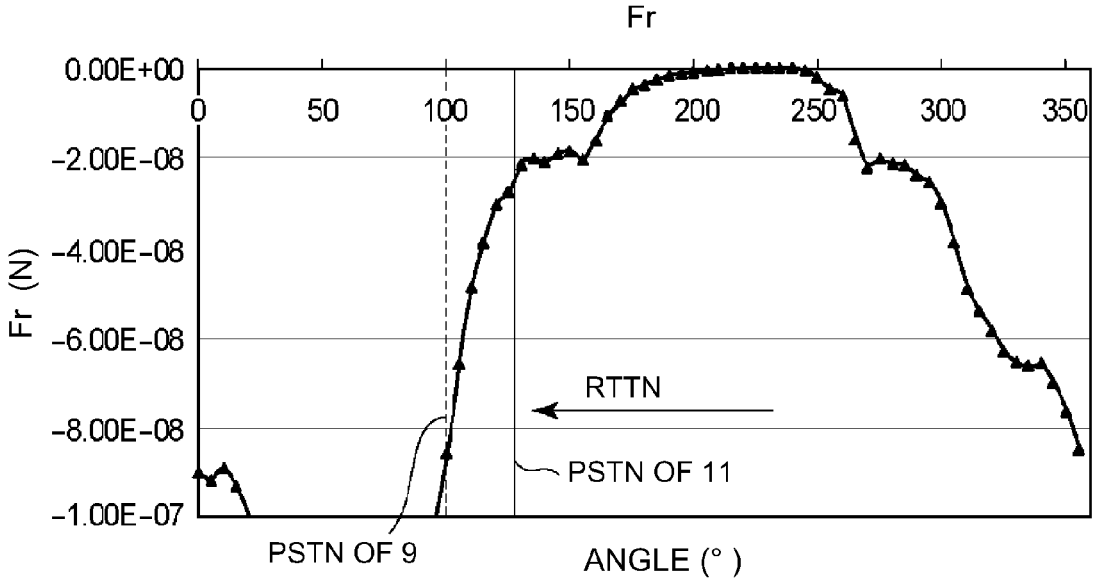
FIG. 18 is a schematic diagram showing a distribution of a magnetic attraction force Fr on the surface of the developing sleeve in Embodiment 3.

Next, with reference to FIGS. 17 and 18, the magnetic flux density Br, the magnetic flux density Be and the magnetic force Fr, with respect to the direction normal to the sleeve, which acts from the magnet pattern 5 used in this embodiment will be described. In FIGS. 17 and 18, the developer is conveyed from right to left, and the regulating blade 9 is disposed at the position of 100 degrees similarly as in Embodiment 1 (broken lines in FIGS. 17 and 18). The negative (−) Fr is directed in the attraction force direction to the sleeve, and the positive (+) Fr is directed in the repelling force direction from the sleeve. In this embodiment, as shown in FIG. 19, the magnetic closest to the regulating blade 9 in the upstream side with respect to the sleeve rotational direction is the S1 pole, and in Embodiment 1, the regulating blade upstream pole is the N1 pole for forming the repelling electric field with the same polarity-adjacent pole, thus being different in arrangement of the magnetic poles from that in Embodiment 1.

However, also in this embodiment, Fr between the feeding guide 11 and the regulating blade 9 constituted so as to be abruptly and monotonically increased with a position closer to the regulating blade 9. The feeding guide 11 is disposed at a position of about 130 degrees (solid lines in FIGS. 17 and 18). Further, in the upstream side of the feeding guide 11, the magnetic poles are constituted so that at least Fr is in the positive region (repelling force direction). In this embodiment, the positions from about 200 degrees to about 240 degrees constitute the repelling force region, and a constitution in which Fr is increased from the repelling force region toward a downstream side with respect to the developing sleeve rotational direction is employed. That is, similarly as in Embodiment 1, the Fr distribution having the increase tendency such that Fr is increased from the feeding guide 11 toward the regulating blade 9 is shown.

Similarly as in Embodiments 1 and 2, in the environmental condition of 45° C., the result of execution of the continuous idling of the developing device containing the developer without replacing the developer with the new developer is shown in Table 3.

TABLE 3

| CN*1 | MP*2 | BGD*3 | RATIO*4 | Result |
|---|---|---|---|---|
| 1 | 1 | 3.5 mm | 72% | NO I.C. |
| 2 | | 5.2 mm | 60% | NO I.C. |
| 3 | | 7.8 mm | 56% | I.C. 4*5 |
| 4 | 2 | 5.2 mm | 36% | I.C. 0.5*6 |
| 5 | 3 | 5.2 mm | 48% | I.C. 2*7 |
| 6 | | 4.4 mm | 63% | NO I.C. |
| 7 | | 2.8 mm | 89% | NO I.C. |
| 8 | 4 | 5.2 mm | 64% | NO I.C. |
| 9 | 5 | 5.2 mm | 60% | NO I.C. |

*1"CN" is a condition.
*2"MP" is a magnet pattern.
*3"BGD" is a distance between the regulating blade and the feeding guide.
*4"RATIO" is FrNear/FrAll.
*5"I.C. 4" is improper coating generated by idling for 4 hours.
*6"I.C. 0.5" is improper coating generated by idling for 0.5 hour.
*7"I.C. 2" is improper coating generated by idling for 2 hours.

<Result>

Condition 9 shows the result of Embodiment 3. In the condition 9, the ratio of FrNear/FrAll was 60%, and it was turned out that the improper coating was not generated.

In the magnetic pole arrangement in FIG. 19, the upstream pole of the N1 pole having the magnetic flux density is the repelling magnetic pole N3 (N3 pole) and therefore the gradient of the magnetic flux density between the N1 and N3 poles is small. In the downstream side of the N1 pole, the S1 pole which is different in polarity from the N1 pole and which has the magnetic flux density somewhat larger than the N1 pole is located adjacent to the N1 pole, and therefore the magnetic flux density gradient is somewhat larger than that in the upstream side of the N1 pole. Further, the N2 pole adjacent to S1 in the downstream side has the magnetic flux density larger than the S1 pole and therefore the gradient of the change in magnetic flux density becomes large. Therefore, according to the magnetic pole constitution in Embodiment 3, with respect to the developing sleeve rotational direction, the magnetic flux density gradient is stepwisely increased in the order of N1 pole, the feeding guide position, the S1 pole, the regulating blade position and the N2 pole. For this reason, between the feeding guide position and the regulating blade position, Fr which is proportional to the gradient of the square of the magnetic flux density shows the monotonic increase tendency. As a result, the ratio of FrNear/FrAll satisfied 60% or more, so that the generation of the improper coating could be prevented.

Embodiment 4

A basic constitution of an image forming apparatus in this embodiment is the same as that in Embodiment 1 and therefore description of a general structure of the image forming apparatus will be omitted. Also in this embodiment, the constitutions of the magnet in the developing sleeve and the feeding guide member are the same as those in Embodiments 1 to 3, so that stagnation of the developer in the upstream side of the regulating blade can be suppressed. In this embodiment, in order to further improve the conveying property of the developing sleeve, an example in which a developing sleeve subjected to grooving at its surface along its longitudinal direction is employed will be described.

[Groove Pitch of Developing Sleeve]

Figure 23:
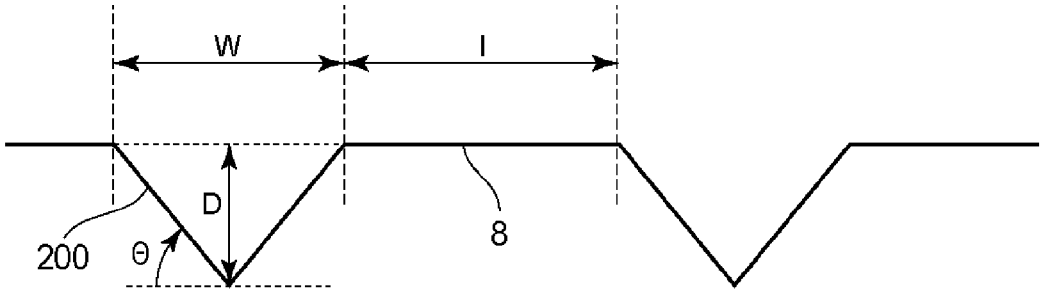
FIG. 23 is a schematic view for illustrating a groove shape of a developing sleeve surface in Embodiment 4.
Figure 24:
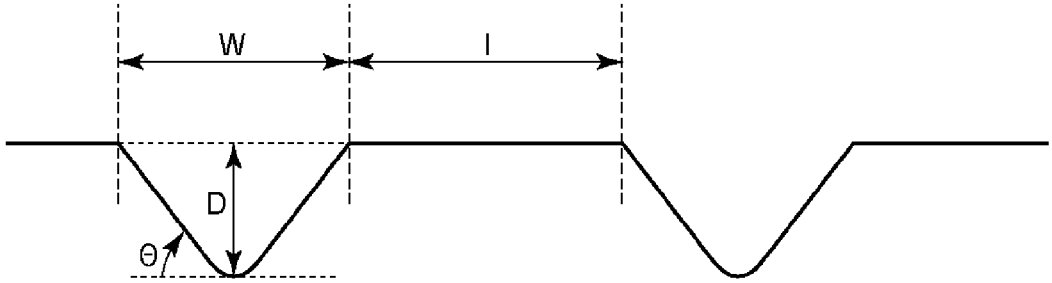
FIGS. 24, 25 and 26 are schematic views each for illustrating another example of the groove shape of the developing sleeve surface in Embodiment 4.
Figure 25:
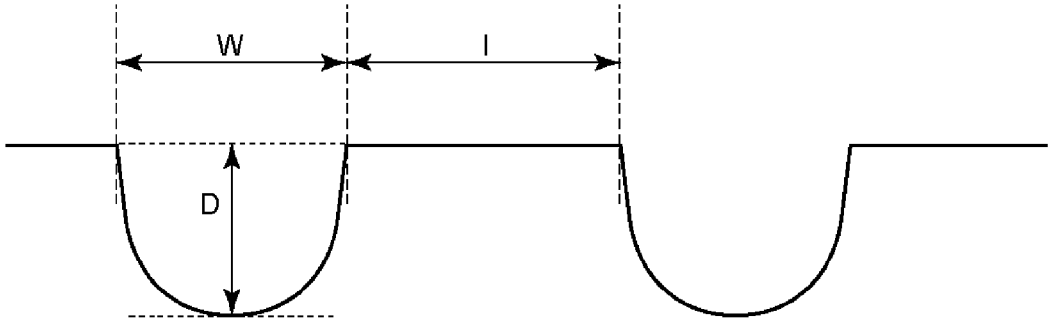
Figure 26:
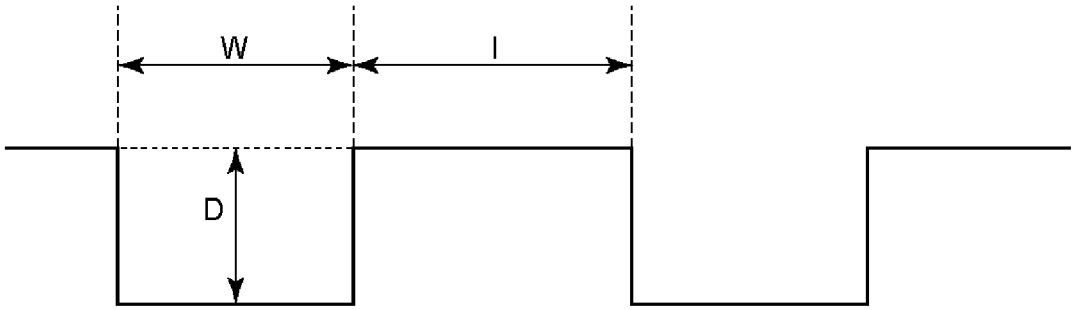

FIG. 23 is a schematic view of a groove shape employed in this embodiment. In this embodiment, 50 grooves each having a bilaterally symmetrical V-shape of 50 μm in depth D and 140 μm in width W are formed or the developing sleeve at an interval I of about 1120 μm in parallel to a developing sleeve axial line. Further, an angle θ of the V-shaped groove is about 45 degrees. The groove shape is not limited to the V-shape so long as the developer is caught by and conveyed along the groove portion, but may also be partly rounded V-shape, a V-shape and a rectangular shape as shown in FIGS. 24, 25 and 26. However, in either case, in order to catch the developer, there is a need that at least one carrier particle enters the groove portion, and therefore the carrier diameter is required to be smaller than the groove depth D and the groove width W.

As in this embodiment, in a constitution in which the feeding guide 11 is provided and the magnetic force in the neighborhood of the regulating blade 9 is made large to eliminate the stagnation of the developer in the neighborhood of the regulating blade 9, there is a possibility that coating of the developer on the developing sleeve 8 becomes non-uniform depending on the groove pitch of the developing sleeve 8. The developer is principally constrained by the groove portion while forming a magnetic chain by the magnet incorporated in the developing sleeve 8, and receives a force from the magnetic chain constrained by the groove portion, thus being conveyed while being pushed out. For this reason, the conveying property is largely different between the presence and absence of the groove portion at the developer stagnation portion located between the regulating blade 9 and the feeding guide 11. Therefore, in this embodiment, in order to suppress the above-described density non-uniformity, the sum of the width and the interval, i.e., W+I is made smaller than a distance L between the regulating blade 9 and the feeding guide 11. In such a case, irrespective of the position of the developing sleeve 8, it is possible to provide at least one groove portion in the region between the regulating blade 9 and the feeding guide 11. For this reason, the developer between the regulating blade 9 and the feeding guide 11 can be always conveyed by the groove portion, so that the developer can be coated on the developing sleeve 8 without interruption.

In this embodiment, the length L is 4190 μm and the total length W+I which is the sum of the grooves and projections each between the adjacent grooves is 1260 μm and therefore satisfies the above-described requirements.

Comparison Example

As a comparison example, a developing sleeve provided with 12 grooves each formed in a bilaterally symmetrical V-shape of 50 μm in depth D and 140 μm in width W in parallel to a developing sleeve axial line at an interval I of 5100 μm is used. A distance between a point of intersection P1 of the developing sleeve surface with a line extended from the feeding guide 11 toward the developing sleeve 8 and a point of intersection P2 of the developing sleeve surface with a line extended from the feeding guide-side surface of the regulating blade 9 toward the developing sleeve 8 is taken as a length L along the developing sleeve surface. In this case, the total length W+I which is the sum of the widths W of the grooves and the intervals I of the projections each between the adjacent groves is larger than the length L. For this reason, there arises the case where one carrier particle does not enter the groove portion between the feeding guide 11 and the regulating blade 9, so that the problem described above is generated.

<Experiment>

An experiment for substantiating the effect of the present invention in Embodiment 4 will be described.

A chart used in this experiment was a whole surface solid image on an A4 sheet, and a reflection density as measured by a densitometer ("Model: 504", mfd. by X-rite Co.) was about 1.5. Measuring points include 3 points at positions of 30 mm from lateral sides of the A4 chart and at a center position and include 20 points starting from a reference point of 10 mm from an upper edge toward a lower edge at an interval of 10 mm with respect to a length direction, so that 60 measuring points in total were provided per A4 sheet. Table 4 below shows a result of evaluation of in-plane density non-uniformity in Embodiment 4 and Comparison example. Values in Table 4 can be obtained by measuring the density at 87 patch portions by the densitometer ("Model: 504", mfd. by X-rite Co.), and are given as a difference of the density, i.e., (maximum)−(minimum), at 60 points on the A4 chart. From Table 4, it is understood that in Comparison Example, the in-plane density non-uniformity is confirmed but in Embodiment 4, the image density non-uniformity is small, i.e., the image density is roughly good.

TABLE 4

| | Density non-uniformity |
|---|---|
| Embodiment 4 | 0.07 |
| Comparative Example 1 | 0.23 |

Embodiment 5

A basic constitution of an image forming apparatus in this embodiment is the same as that in Embodiment 1 and therefore description of a general structure of the image forming apparatus will be omitted. Also in this embodiment, the constitutions of the magnet in the developing sleeve and the feeding guide member are the same as those in Embodiments 1 to 3, so that stagnation of the developer in the upstream side of the regulating blade can be suppressed. A difference between this embodiment and Embodiment 1 is that the first feeding screw 5 is provided with a rib member in order to improve a feeding property of the developer to the developing sleeve.

[First Feeding Screw]

Figure 27:
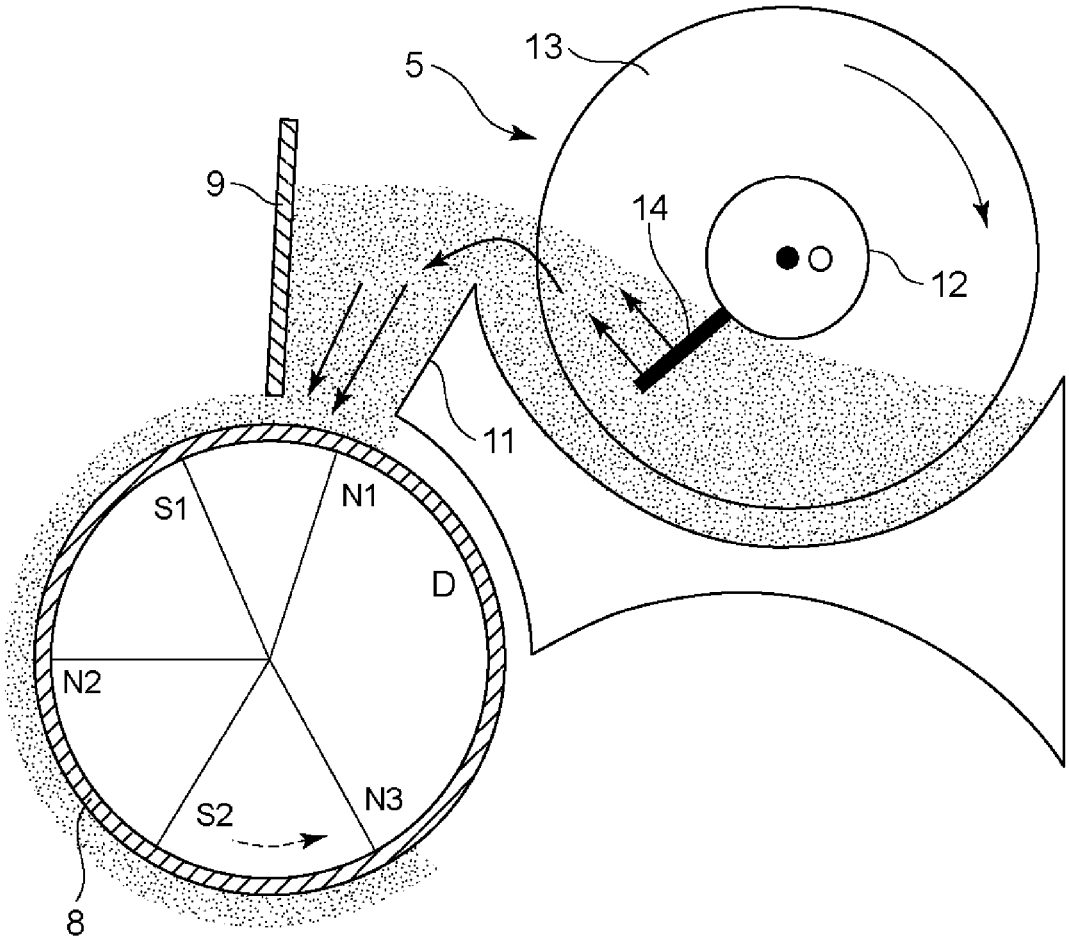
FIG. 27 is a sectional view for illustrating feeding of a developer from a first feeding screw in Embodiment 5.
Figure 28:
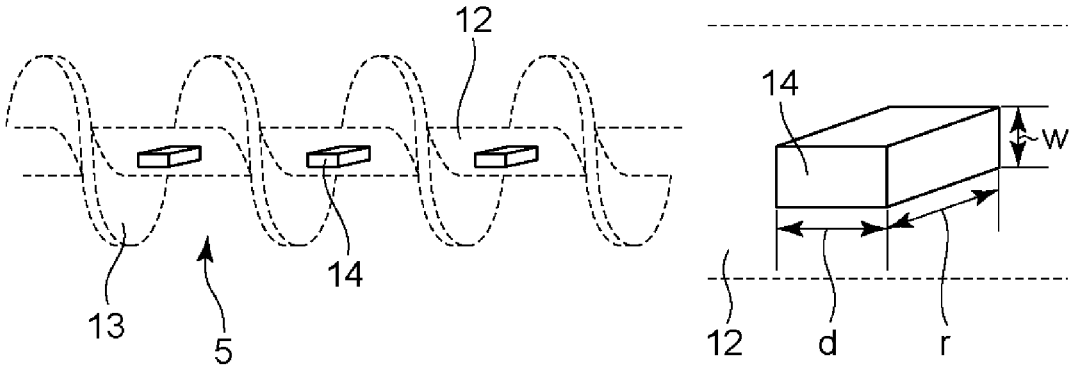
FIGS. 28, 29 and 30 are schematic views each for illustrating the first feeding screw in Embodiment 5.
Figure 29:
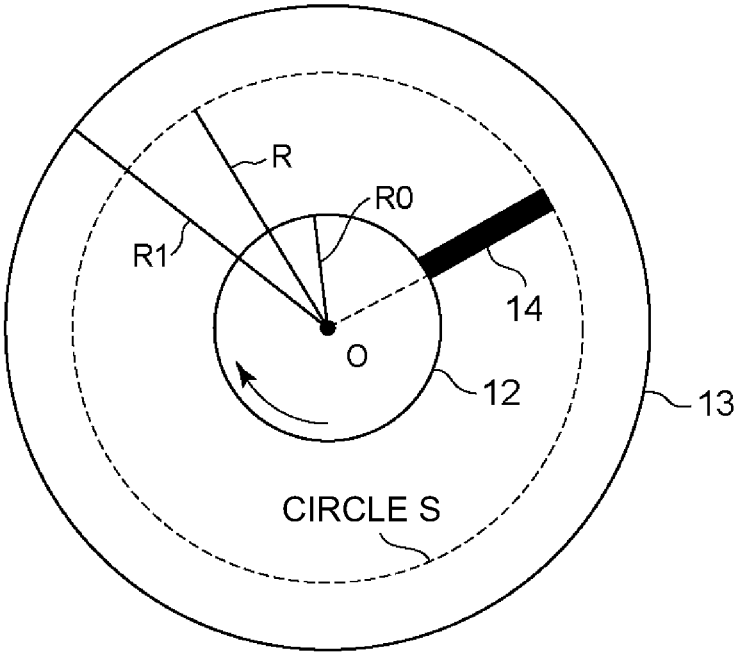
Figure 30:
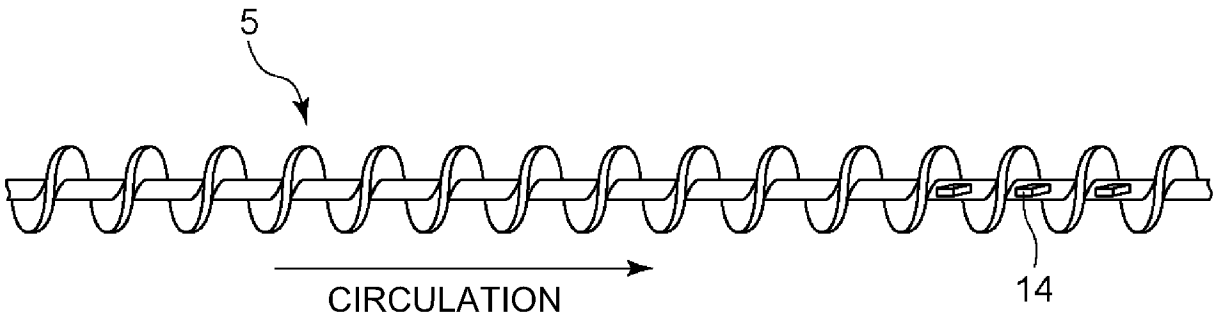
Figure 31:
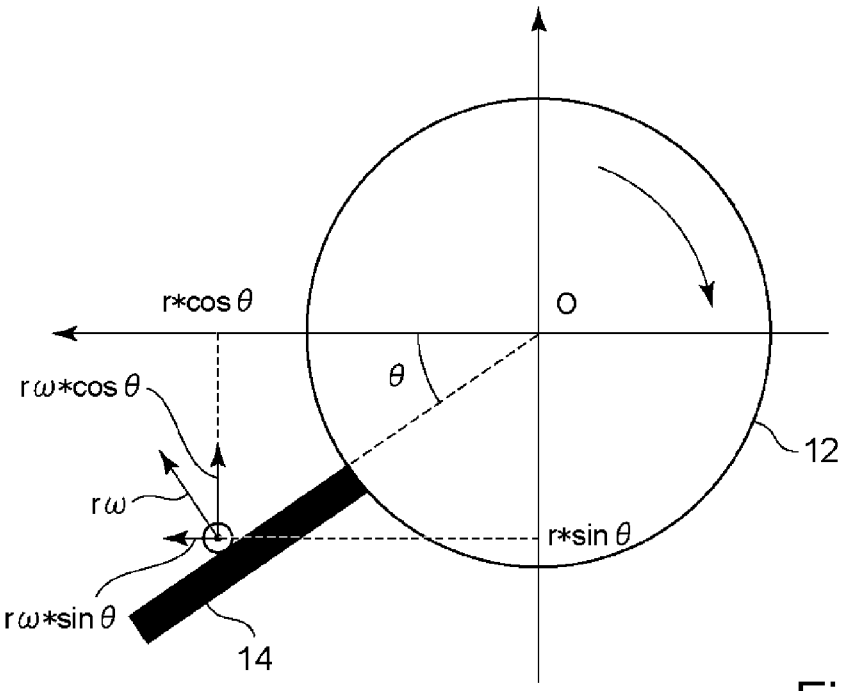
FIGS. 31 and 32 are schematic views each for illustrating a rib member in Embodiment 5.

FIG. 27 is a sectional view of a developing device in this embodiment. FIGS. 28 and 30 are perspective views for illustrating the first feeding screw 5 in this embodiment. FIG. 29 is a sectional view of the first feeding screw 5 in this embodiment with respect to a direction perpendicular to a shaft (axis) direction of the first feeding screw 5. In this embodiment, the first feeding screw 5 has a radius R0 of 3 mm with respect to its rotation shaft and a radius R1 of 10 mm with respect to its outer diameter. Over the rotational axis direction, the stirring blade 13 is provided in a spiral shape at an interval (pitch p) of 30 mm, and is rotated at a peripheral speed of 800 rpm. As described above, a rib member 14 is radially protruded from the rotation shaft surface so that a plane including an opposing surface to the first feeding screw 5 with respect to the rotational direction of the first feeding screw 5 includes a center O of the rotation shaft 12.

The rib 14 is a quadrangular prism member of 7 mm in height r from the rotation shaft center O, 10 mm in width d and 1 mm in thickness w. The rib member 14 was provided in a proportion of one rib per one pitch in a region of 3 pitches from the downstream most stirring blade with respect to a circulation direction of the developer. Incidentally, in this embodiment, also the second feeding screw has the same rotation shaft diameter, outer shape of the stirring blade, pitch and peripheral speed as those of the first feeding screw. In the case of the developing device of the vertical stirring type, with the position toward the downstream side with respect to the developer circulation direction, the surface of the developer is lowered (FIG. 3) and therefore the rib member 14 may only be required to be disposed in the downstream side of the first feeding screw with respect to the developer circulation direction. Rather, by disposing the rib member 14 only in the downstream side of the first feeding screw with respect to the developer circulation direction, it is possible to prevent excessive supply of the developer in the upstream side. As a result, it is possible to realize uniform supply of the developer over the rotational axis direction of the first feeding screw and thus to realize stable coating of the developer on the developing sleeve over a long length. Further, in the case where the rib member is excessively provided in the upstream side with respect to the developer circulation direction, due to excessive supply of the developer in the upstream side, the stagnated developer portion becomes excessively large, so that a problem of torque-up of the first feeding screw due to rise in developer pressure is generated in some cases. Therefore, by providing the rib member only in the downstream side, also this problem can be obviated with reliability. In this embodiment, the rib member is provided in the proportion of one rib per one pitch in the region of 3 pitches from the downstream most stirring blade with respect to the developer circulation direction, but the manner of provision is not limited thereto. In some cases, the rib member may also be provided in the entire region of the first feeding screw. The rib member 14 is rotated together with the first feeding screw. For that reason, the developer striking on a portion of r in height from the rotation shaft center O is reflected at an initial speed rω in a direction perpendicular to the opposing surface to the rotational direction of the rib member as shown in FIG. 3 ($R0<r<R$). Here, an angular speed of the first feeding screw is ω (rad/s), the radius of the rotation shaft 12 is R0, and the height of the rib member 14 is R.

Figure 33:
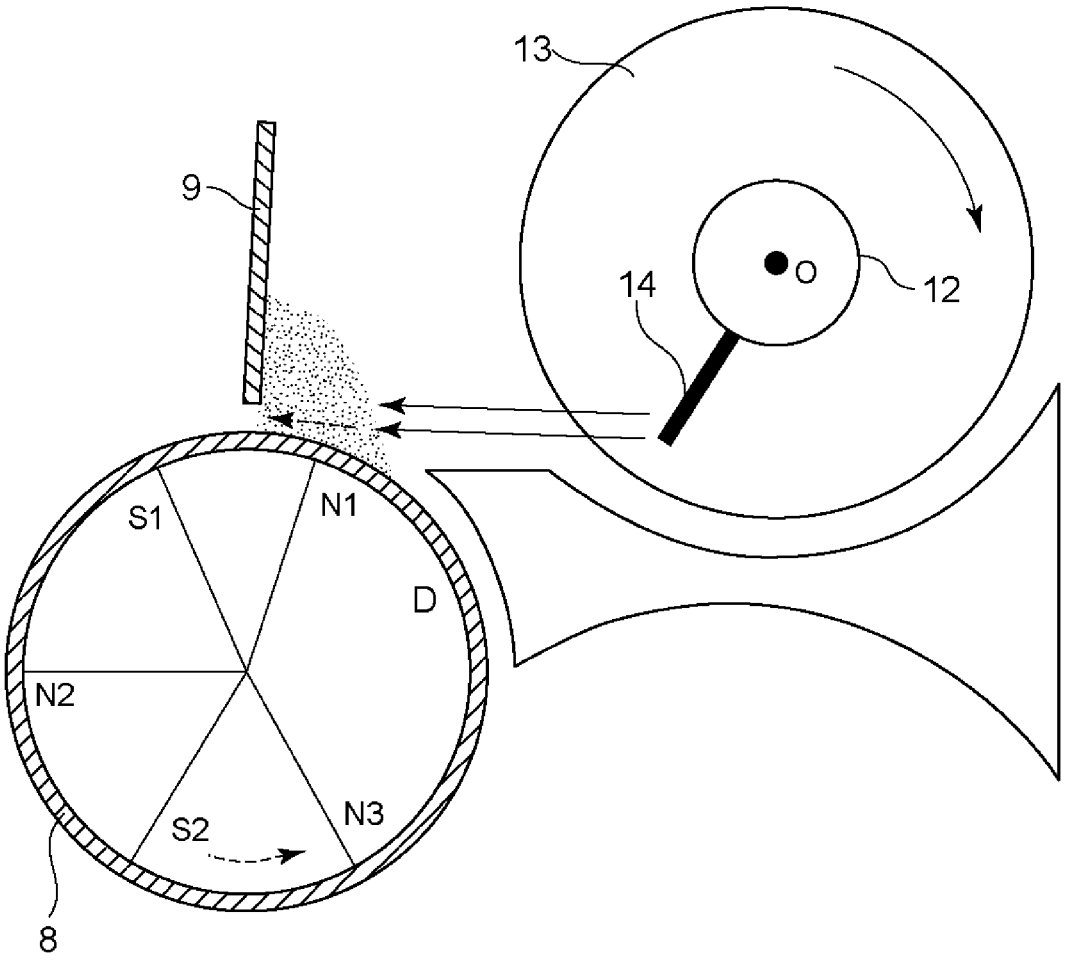
FIG. 33 is a sectional view showing feeding of a developer from a rib member in a conventional developing device.
Figure 34:
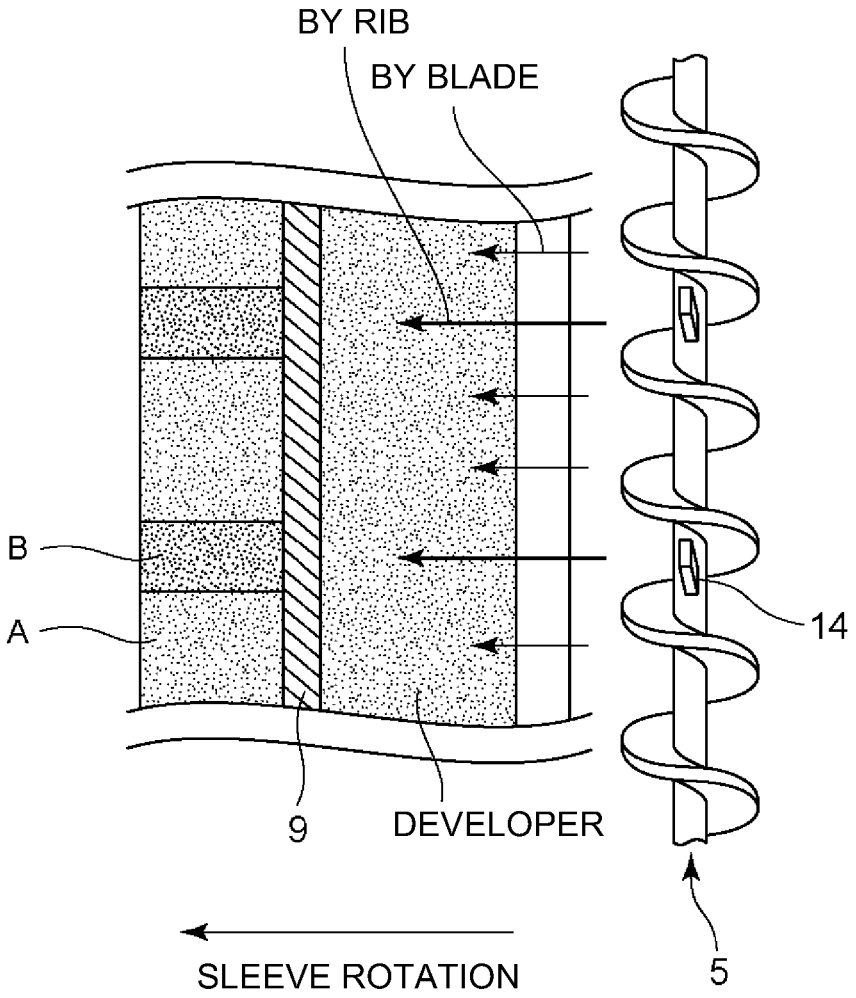
FIG. 34 is a schematic view, as seen from above in the vertical direction, showing the feeding of the developer from the rib member in the conventional developing device.

In general, in the case where the rib member for accelerating the supply of the developer from the first feeding screw to the developing sleeve is provided, the pressure applied to the stagnated developer with respect to the axial direction of the developing sleeve is liable to become non-uniform. As a result, in some cases, the developer coating on the developing sleeve becomes non-uniform and thus density non-uniformity along a trace of the rib member is generated on the image. The developer is directed supplied to the stagnated developer at the back side of the regulating blade by the rib member with respect to a direction substantially in parallel to the developing sleeve and therefore at a portion where the regulating blade is provided the pressure is largely applied to the stagnated developer. Further, at a portion where the regulating blade is not provided, the pressure is smally applied to the stagnated developer. For example, as shown in FIG. 33, in the case where there is no obstructing member between the first feeding screw and the stagnated developer in the backside of the regulating blade, the developer supplied by the rib member 14 is directly supplied to the back side of the regulating blade. FIG. 34 is a schematic view of the developing device of FIG. 14 as seen from above the developing device. The pressure applied to the stagnated developer is large at the portion where the rib member is provided and is small at the portion where the rib member is not provided. As a result, non-uniformity of the thickness of the developer coated on the developing sleeve is generated correspondingly to the portion where the rib member is provided. In FIG. 34, the rib member is not provided in region A and is provided in region B.

Figure 35:
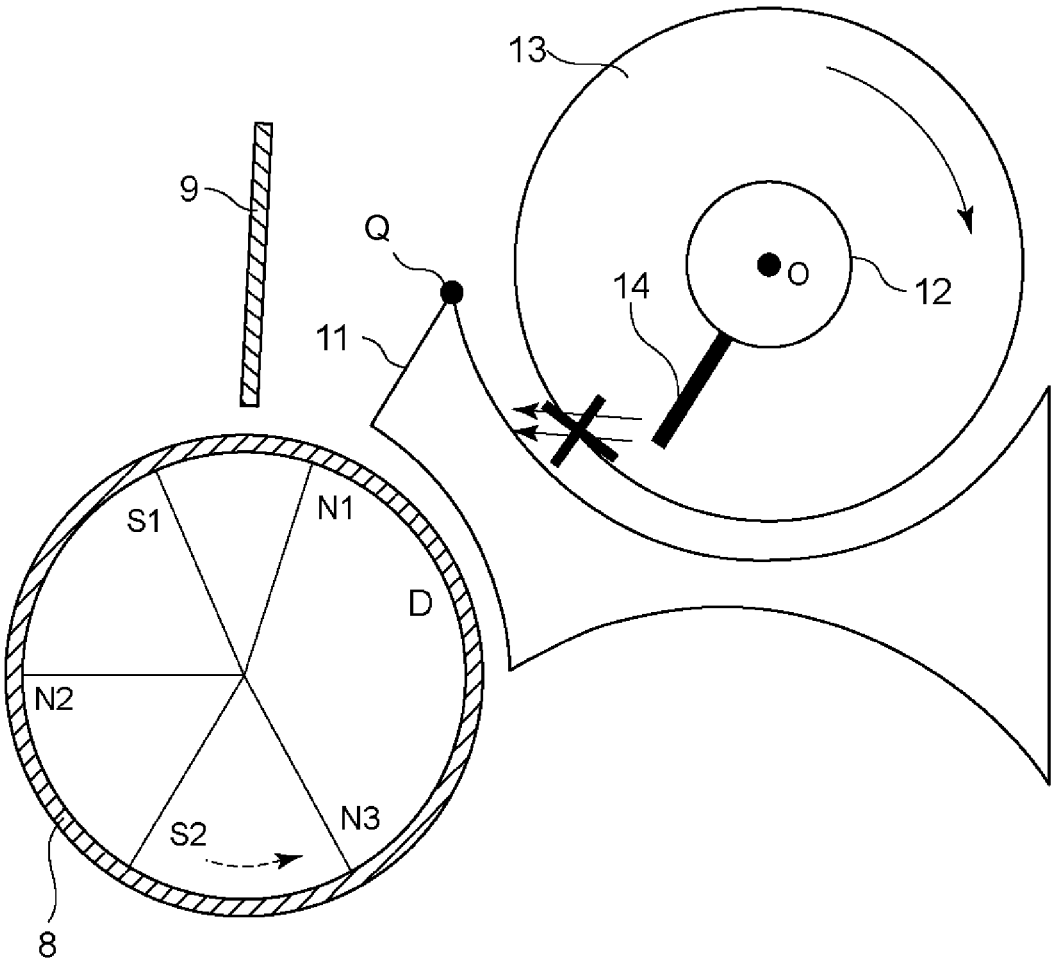
FIG. 35 is a sectional view showing feeding of the developer from the rib member in Embodiment 5.

On the other hand, in the developing device in which the feeding guide member is provided, by appropriately selecting the positions of the first feeding screw, the rib member and the guiding member, the supply of the developer, in parallel to the developing sleeve, from the first feeding screw is not effected directly toward the stagnated developer in the back side of the regulating blade. Therefore, in the developing device in which the feeding guide member is provided, it is originally difficult to arise the problem of the rib trace described above (FIG. 35).

That is, in the present invention, a height H of the feeding guide member (i.e., a top point Q (a, b) represented by Cartesian coordinates with the first feeding screw rotation shaft center as the origin) is set at a certain value or more. Thus, the supply of the developer in parallel to the developing sleeve is suppressed, so that the supply of the developer can be accelerated by the rib member while suppressing the above-described problem.

In general, adjustment of the coating amount of the developer on the developing sleeve is made by layer thickness regulation by chain cutting with the regulating blade. Therefore, non-uniformity of the pressure applied in parallel to the developing sleeve at point P of intersection of the developing sleeve surface with a line extended from the chain cutting portion, i.e., the regulating blade to the developing sleeve may only be required to be suppressed, and in the end, the top point Q of the feeding guide member may only be required to be located above the point P. By employing such a constitution, of the developer supplied from the rib member, a portion of the developer parallel to the developing sleeve at the chain cutting portion is blocked by the feeding guide member, so that the problem of the rib trace is suppressed.

Here, in this embodiment, in order that the developer supplied from the rib member 14 gets over the feeding guide member, there is a need to satisfy a formula below. By providing the rib member 14, the supply of the developer to a region defined by the feeding guide member 11 and the regulating blade 9 can be accelerated.

$$b<-g/2\times((a-r\times\cos\theta)/(r\omega\times\sin\theta))^2+(a-r\times\cos\theta)\times\cos\theta/\sin\theta-r\times\sin\theta,\ \text{where } R0\le r\le R, 0<\theta<1/\pi, \text{ and } H=b-c. \quad \text{(formula 1)}$$

Figure 32:
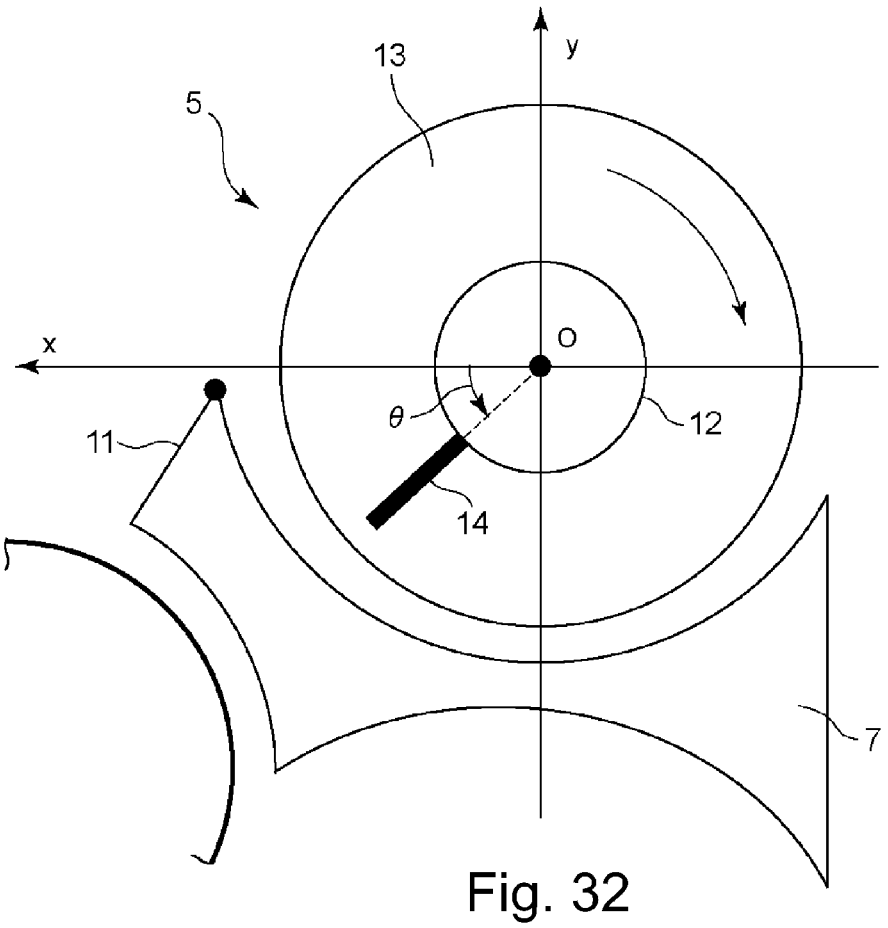

In the above formula, g is gravitational acceleration, a is x-coordinate of the top point Q of the feeding guide member in Cartesian coordinates with the first feeding screw rotation shaft center as the origin, b is y-coordinate of the top point Q of the feeding guide member in Cartesian coordinates with the first feeding screw rotation shaft center as the origin, c is y-coordinate of the lowest point of the feeding guide member in Cartesian coordinates with the first feeding screw rotation shaft center as the origin, and θ is an angle formed between the horizontal line passing through the first feeding screw rotation shaft center and the rib member (radian notation in which a positive value is increased with respect to the counterclockwise direction as shown in FIG. 32).

It should be noted that any one of values of r and θ which satisfy: $R0\le r\le R$ and $0<\theta<1/\pi$ may only be required to satisfy the above-described formula 1. Specific description will be made below.

Cartesian coordinates with the first feeding screw rotation shaft center as the origin are taken, and an angle formed between x-axis and the rib member is θ. Assuming that the rotating rib member shows a certain angle θ, when the developer strikes a portion spaced from the rotation shaft center by r, the developer is reflected at an initial speed $r\omega\times\sin\theta$ in x-direction and at an initial speed $r\omega\times\cos\theta$ in y-direction. The reflected developer is attracted by gravitation to perform parabolic motion and therefore effects uniform motion at the initial speed $r\omega\times\sin\theta$ in x-direction and acceleration motion of $d^2x/dt^2=g$ in y-direction. In order that the reflected developer gets over the feeding guide member, the y-coordinate of the developer may only be required to be larger than the y-coordinate b of the top point Q at the position of the x-coordinate a of the top point Q of the feeding guide member. The position at the moment when the developer is reflected is $(r\times\cos\theta, r\times\text{sine})$ and therefore a time t(a) when the reflected developer reaches the x-coordinate a is $t(a)=(a-r\times\cos\theta)/r\omega\times\sin\theta$. Accordingly, the y-coordinate of the developer at this time is represented by $y(a)=-g/2\times t(a)^2+t(a)\times r\omega\times\cos\theta-r\times\sin\theta=-g/2\times((a-r\times\cos\theta))/(r\omega\times\sin\theta))^2+(a-r\times\cos\theta)\times\cos\theta/\sin\theta-r\times\sin\theta$. Unless $b<y(a)$, the developer reflected by the rib member cannot get over the feeding guide member and therefore the formula 1 is required to be satisfied in order that the developer reflected by the rib member gets over the feeding guide member. The developer is reflected by the rib member at various positions of r ($R0\leq r\leq R$) and θ ($0<e<1/\pi$). For that reason, in a range of $R0\leq r\leq R$ and $0<\theta<1/\pi$, when the formula 1 is satisfied no matter to how slight a degree, it is possible to accelerate the supply of the developer to the region defined by the feeding guide member and the regulating blade by providing the rib member.

Next, an experiment for substantiating an effect in this embodiment will be described. Table 5 shown below is a table showing a coating limit on the developing sleeve each in the developing device in this embodiment and in a conventional developing device.

The coating limit on the developing sleeve refers to a minimum amount of the developer in the developing device for permitting normal coating of the developer on the developing sleeve. When the developer amount in the developing device is less than this amount, improper coating such that a portion where there is no coating on the developing sleeve is partly generated is caused to occur. Under present circumstances, the coating limit on the developing sleeve is an index of the improper coating on the developing sleeve and can be measured in general in the following manner.

In a state in which the developing sleeve and the first and second feeding screws are driven at desired peripheral speeds, the developer is gradually placed in the developing container. With an increasing amount of the developer in the developing container, the coating of the developer on the developing sleeve is gradually thicken from the upstream side of the first feeding screw with respect to the developer circulation direction, and then reaches a desired thickness in the entire region of the developing sleeve. At this time, the amount of the developer in the developing container is the coating limit on the developing sleeve and can be obtained by, e.g., measuring the weight of the developing device.

TABLE 5

| | Coating limit (g) |
|---|---|
| Conventional | 290 |
| Embodiment 5 | 260 |

As shown in Table 5, in order to normally coat the developing sleeve with the developer, the conventional developing device requires at least 290 g. On the other hand, in this embodiment, when the developing device contains 260 g of the developer, the developing sleeve can be normally coated with the developer.

As described above, by providing the first feeding screw with the rib member, it was possible to accelerate the supply of the developer to the developing sleeve to suppress the improper coating of the developer on the developing sleeve without a harmful influence such as the rib trace.

While the invention has been described with reference to the structures disclosed herein, it is not confined to the details set forth and this application is intended to cover such modifications or changes as may come within the purpose of the improvements or the scope of the following claims.

INDUSTRIAL APPLICABILITY

According to the present invention, it is possible to provide a developing device capable of, without providing a new member or the like, suppressing generation of image defect due to formation of the immobile layer in the upstream side of the developer regulating member for regulating the amount of the developer on the developer carrying member.

The invention claimed is:

1. A developing device comprising:

a developer carrying member for carrying a developer comprising a toner and a carrier;

a magnet provided inside said developer carrying member;

a developing chamber for feeding the developer to said developer carrying member;

a feeding member rotatable provided in the developing chamber for feeding the developer in said developing chamber;

a non-magnetic blade member for regulating an amount of the developer to be coated on said developer carrying member; and a route forming portion for forming a route for feeding the developer in the developing chamber from above to said developer carrying member with respect to a direction of gravitation, wherein said routing forming portion is located between said feeding member and said developer carrying member and includes an opposing portion opposed to said developer carrying member along a peripheral surface of said developer carrying member, wherein the magnet is opposed to a first region of said developer carrying member from a downstream end of said opposing portion with respect to the rotational direction of said developer carrying member to said blade member in the rotational direction of said developer carrying member so as to attract the developer on the first region, and wherein a distance of the first region in the rotational direction of said developer carrying member is 2 mm or more, and when a magnetic force at a surface of said developer carrying member with respect to a direction normal to said developer carrying member is Fr, magnetic poles are provided so that a ratio of an integrated value FrNear to an integrated value FrAll is 60% or more, wherein the integrated value FrNear is obtained by integrating the magnetic force Fr in a second region of the developer carrying member from a position of 2 mm upstream of said blade member with respect to the rotational direction of said developer carrying member to said blade member with respect to the rotational direction of said developer carrying member and the integrated value FrAll is obtained by integrating the magnetic force in the first region.

2. A developing device according to claim 1, wherein in the first region, a position where an absolute value of the magnetic force Fr is maximum is an opposing position to said blade member.

3. A developing device according to claim 1, wherein the magnetic poles are provided so that an absolute value of the magnetic force Fr is monotonously increased from the downstream end of said opposing portion toward said blade member with respect to the rotational direction of said developer carrying member.

4. A developing device according to claim 3, wherein progression of the magnetic force Fr with respect to the rotational direction of said developer carrying member is progression when the magnetic force Fr is detected at a sampling interval of 2 degrees to 10 degrees.

5. A developing device according to claim 1, wherein with drive of said developer carrying member, the developer opposing said blade member is fed toward said surface of said developer carrying member along said blade member.

6. A developing device according to claim 1, wherein said magnet including a magnetic pole closest to a position of said blade member has a magnetic flux density Br of 20 mT to 80 mT in peak strength.

7. A developing device according to claim 1, wherein said magnet includes magnetic poles including a pair of adjacent magnetic poles of the same polarity, and wherein a downstream magnetic pole of said pair of adjacent magnetic poles with respect to the rotational direction of said developer carrying member is closest to said blade member.

8. A developing device according to claim 1, wherein said developing device develops a latent image formed on an image bearing member, and said magnet includes a cut pole which is closest to said blade member, a development pole which is closest to the image bearing member, and a feeding pole disposed between said cut pole and said development pole.

9. A developing device according to claim 8, wherein a magnetic flux density of said feeding pole at a surface of said developer carrying member with respect to a direction normal to said developer carrying member is larger than that of said cut pole.

10. A developing device according to claim 8, wherein said magnet includes an upstream magnetic pole disposed adjacent to said cut pole and disposed upstream of said cut pole with respect to the rotational direction of said developer carrying member, and a distance from said cut pole to said feeding pole with respect to the rotational direction along a peripheral surface of said developer carrying member is shorter than a distance from said upstream magnetic pole to said cut pole with respect to the rotational direction along a peripheral surface of said developer carrying member.

11. A developing device according to claim 1, further comprising:

a stirring chamber for stirring the developer, wherein the developer is circulated between said developing chamber and said stirring chamber; and a partition wall for partitioning said developing chamber and said stirring chamber, wherein said route forming member is located on said partition wall.

12. A developing device according the claim 1, wherein said feeding member includes a center shaft, a helical blade portion formed around said center shaft, and a rib portion which is formed in a pitch of said blade member and which projects from said center shaft.

13. A developing device according to claim 1, wherein a top point of said route forming portion is provided at a position higher than a lower free end position of said blade member.

* * * * *